US010388115B2

(12) United States Patent
Arnone et al.

(10) Patent No.: US 10,388,115 B2
(45) **Date of Patent: *Aug. 20, 2019**

(54) INSURANCE ENABLED HYBRID GAMING SYSTEM

(71) Applicant: Gamblit Gaming, LLC, Glendale, CA (US)

(72) Inventors: Miles Arnone, Sherborn, MA (US); Caitlyn Ross, Watertown, MA (US); Eric Meyerhofer, Pasadena, CA (US); Frank Cire, Pasadena, CA (US)

(73) Assignee: Gamblit Gaming, LLC, Glendale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/005,108

(22) Filed: Jun. 11, 2018

(65) Prior Publication Data

US 2018/0293848 A1 Oct. 11, 2018

Related U.S. Application Data

(63) Continuation of application No. 15/170,773, filed on Jun. 1, 2016, now Pat. No. 9,997,024, which is a (Continued)

(51) Int. Cl.
*G07F 17/32* (2006.01)

(52) U.S. Cl.
CPC ..... *G07F 17/3267* (2013.01); *G07F 17/3227* (2013.01); *G07F 17/3244* (2013.01); *G07F 17/3251* (2013.01); *G07F 17/3258* (2013.01)

(58) Field of Classification Search
USPC ..... 463/25
See application file for complete search history.

(56) References Cited

U.S. PATENT DOCUMENTS 5,413,357 A 5/1995 Schulze et al.
5,718,429 A 2/1998 Keller
(Continued)

FOREIGN PATENT DOCUMENTS

JP 2001300098 A 10/2001
JP 2003111980 A 4/2003
(Continued)

OTHER PUBLICATIONS itl.nist.gov, Extreme Studentized Deviate Test, [online], Sep. 2010, Internet<URL:http://www.itl.nist.gov/div898/software/dataplot/refman1/auxillar/esd.htm>, entire document, National Institute of Standards and Technology (NIST), U.S. Department of Commerce.
(Continued)

*Primary Examiner* — Pierre E Elisca
(74) *Attorney, Agent, or Firm* — Frank Cire; Caityln Ross

(57) ABSTRACT

An insurance enabled hybrid gaming system including a terminal with an entertainment software engine, a real world engine, and a game world engine connecting the entertainment software engine and the real world engine using a network, the system constructed to provide an entertainment game and a gambling game which activates an insurance proposition associated with an insurance trigger event in the entertainment game in exchange for an insurance fee when there is a gameplay event of the entertainment game dependent upon player action and an insurance module that mitigates the negative outcome.

17 Claims, 12 Drawing Sheets

Related U.S. Application Data continuation of application No. 14/604,629, filed on Jan. 23, 2015, now Pat. No. 9,361,758, which is a continuation of application No. 14/458,206, filed on Aug. 12, 2014, now Pat. No. 8,951,113, which is a continuation of application No. 14/179,492, filed on Feb. 12, 2014, now Pat. No. 8,808,086, which is a continuation of application No. PCT/US2013/026934, filed on Feb. 20, 2013.

(60) Provisional application No. 61/601,708, filed on Feb. 22, 2012.

(56) References Cited

U.S. PATENT DOCUMENTS 5,785,592 A 7/1998 Jacobsen
5,853,324 A 12/1998 Kami et al.
5,963,745 A 10/1999 Collins et al.
6,050,895 A 4/2000 Luciano
6,165,071 A 12/2000 Weiss
6,227,974 B1 5/2001 Eilat
6,267,669 B1 7/2001 Luciano
6,302,791 B1 10/2001 Frohm et al.
6,685,563 B1 2/2004 Meekins et al.
6,712,693 B1 3/2004 Hettinger
6,761,632 B2 7/2004 Bansemer et al.
6,761,633 B2 7/2004 Riendeau
6,764,397 B1 7/2004 Robb
6,811,482 B2 11/2004 Letovsky
7,118,105 B2 10/2006 Benevento
7,294,058 B1 11/2007 Slomiany
7,326,115 B2 2/2008 Baerlocher
7,361,091 B2 4/2008 Letovsky
7,517,282 B1 4/2009 Pryor
7,575,517 B2 8/2009 Parham et al.
7,682,239 B2 3/2010 Friedman et al.
7,720,733 B2 5/2010 Jung
7,753,770 B2 * 7/2010 Walker ..... G07F 17/3244 273/138.1
7,753,790 B2 7/2010 Nguyen
7,766,742 B2 8/2010 Bennett et al.
7,775,885 B2 8/2010 Van Luchene
7,798,896 B2 9/2010 Katz
7,828,657 B2 11/2010 Booth
7,917,371 B2 3/2011 Jung et al.
7,931,531 B2 4/2011 Oberberger
7,938,727 B1 5/2011 Konkle
7,950,993 B2 5/2011 Oberberger
7,967,674 B2 6/2011 Baerlocher
7,980,948 B2 7/2011 Rowe
7,996,264 B2 8/2011 Kusumoto et al.
8,012,023 B2 9/2011 Gates
8,047,908 B2 11/2011 Walker
8,047,915 B2 11/2011 Lyle
8,060,829 B2 11/2011 Jung et al.
8,075,383 B2 12/2011 Friedman et al.
8,087,999 B2 1/2012 Oberberger
8,113,938 B2 2/2012 Friedman et al.
8,118,654 B1 2/2012 Nicolas
8,128,487 B2 3/2012 Hamilton et al.
8,135,648 B2 3/2012 Oram
8,137,193 B1 3/2012 Kelly et al.
8,142,272 B2 3/2012 Walker
8,157,653 B2 4/2012 Buhr
8,167,695 B2 5/2012 Rowe
8,167,699 B2 5/2012 Inamura
8,177,628 B2 5/2012 Manning
8,182,338 B2 5/2012 Thomas
8,182,339 B2 5/2012 Anderson
8,187,068 B2 5/2012 Slomiany
8,206,210 B2 6/2012 Walker
8,308,544 B2 11/2012 Friedman
8,430,735 B2 4/2013 Oberberger
8,475,266 B2 7/2013 Amone
8,480,470 B2 7/2013 Napolitano et al.
8,485,893 B2 7/2013 Rowe
8,622,809 B1 1/2014 Arora et al.
8,864,564 B2 10/2014 Oberberger
8,998,694 B2 4/2015 Rowe
9,070,257 B1 6/2015 Scalise
9,092,946 B2 7/2015 Rowe
9,111,412 B2 8/2015 Rowe
9,454,873 B2 9/2016 Rowe
2001/0004609 A1 6/2001 Walker et al.
2001/0019965 A1 9/2001 Ochi
2002/0022509 A1 2/2002 Nicastro et al.
2002/0090990 A1 7/2002 Joshi et al.
2002/0175471 A1 11/2002 Faith
2003/0060286 A1 3/2003 Walker et al.
2003/0119576 A1 6/2003 McClintic et al.
2003/0139214 A1 7/2003 Wolf et al.
2003/0171149 A1 9/2003 Rothschild
2003/0204565 A1 10/2003 Guo et al.
2003/0211879 A1 11/2003 Englman
2004/0092313 A1 5/2004 Saito et al.
2004/0102238 A1 5/2004 Taylor
2004/0121839 A1 6/2004 Webb
2004/0225387 A1 11/2004 Smith
2005/0003878 A1 1/2005 Updike
2005/0096124 A1 5/2005 Stronach
2005/0116411 A1 6/2005 Herrmann et al.
2005/0192087 A1 9/2005 Friedman et al.
2005/0227756 A1 10/2005 Kane
2005/0233791 A1 10/2005 Kane
2005/0233806 A1 10/2005 Kane et al.
2005/0239538 A1 10/2005 Dixon
2005/0269778 A1 12/2005 Samberg
2005/0288101 A1 12/2005 Lockton et al.
2006/0003823 A1 1/2006 Zhang
2006/0003830 A1 1/2006 Walker et al.
2006/0035696 A1 2/2006 Walker
2006/0040735 A1 2/2006 Baerlocher
2006/0068913 A1 3/2006 Walker et al.
2006/0084499 A1 4/2006 Moshal
2006/0084505 A1 4/2006 Yoseloff
2006/0135250 A1 6/2006 Rossides
2006/0154710 A1 7/2006 Serafat
2006/0166729 A1 7/2006 Saffari et al.
2006/0189371 A1 * 8/2006 Walker ..... G07F 17/3227 463/16
2006/0223611 A1 10/2006 Baerlocher
2006/0234791 A1 10/2006 Nguyen et al.
2006/0240890 A1 10/2006 Walker
2006/0246403 A1 11/2006 Monpouet et al.
2006/0258433 A1 11/2006 Finocchio et al.
2007/0026924 A1 2/2007 Taylor
2007/0035548 A1 2/2007 Jung et al.
2007/0038559 A1 2/2007 Jung et al.
2007/0064074 A1 3/2007 Silverbrook et al.
2007/0087799 A1 4/2007 Van Luchene
2007/0093299 A1 4/2007 Bergeron
2007/0099696 A1 5/2007 Nguyen et al.
2007/0117641 A1 5/2007 Walker et al.
2007/0129149 A1 6/2007 Walker
2007/0142108 A1 6/2007 Linard
2007/0156509 A1 7/2007 Jung et al.
2007/0167212 A1 7/2007 Nguyen
2007/0167239 A1 7/2007 O'Rourke
2007/0173311 A1 7/2007 Morrow et al.
2007/0191104 A1 8/2007 Van Luchene
2007/0202941 A1 8/2007 Miltenberger
2007/0203828 A1 8/2007 Jung et al.
2007/0207847 A1 9/2007 Thomas
2007/0259717 A1 11/2007 Malice
2007/0293306 A1 12/2007 Nee et al.
2008/0004107 A1 1/2008 Nguyen et al.
2008/0014835 A1 1/2008 Weston et al.
2008/0015004 A1 1/2008 Gatto et al.
2008/0064488 A1 3/2008 Oh
2008/0070659 A1 3/2008 Naicker
2008/0070690 A1 3/2008 Van Luchene
2008/0070702 A1 3/2008 Kaminkow
2008/0096665 A1 4/2008 Cohen

(56) References Cited

U.S. PATENT DOCUMENTS

2008/0108406 A1 5/2008 Oberberger
2008/0108425 A1 5/2008 Oberberger
2008/0113704 A1 5/2008 Jackson
2008/0119283 A1 5/2008 Baerlocher
2008/0146308 A1 6/2008 Okada
2008/0161081 A1 7/2008 Berman
2008/0176619 A1 7/2008 Kelly
2008/0191418 A1 8/2008 Lutnick et al.
2008/0195481 A1 8/2008 Lutnick
2008/0242399 A1 10/2008 Toneguzzo
2008/0248850 A1 10/2008 Schugar
2008/0254893 A1 10/2008 Patel
2008/0274796 A1 11/2008 Lube
2008/0274798 A1 11/2008 Walker et al.
2008/0311980 A1 12/2008 Cannon
2008/0318668 A1 12/2008 Ching
2009/0011827 A1 1/2009 Englman
2009/0023489 A1 1/2009 Toneguzzo
2009/0023492 A1 1/2009 Eifanian
2009/0061974 A1 3/2009 Lutnick et al.
2009/0061975 A1 3/2009 Ditchev
2009/0061991 A1 3/2009 Popovich
2009/0061997 A1 3/2009 Popovich
2009/0061998 A1 3/2009 Popovich
2009/0061999 A1 3/2009 Popovich
2009/0082093 A1 3/2009 Okada
2009/0088239 A1 4/2009 Iddings
2009/0098934 A1 4/2009 Amour
2009/0118006 A1 5/2009 Kelly et al.
2009/0124344 A1 5/2009 Mitchell et al.
2009/0131158 A1 5/2009 Brunet De Courssou et al.
2009/0131175 A1 5/2009 Kelly et al.
2009/0143141 A1 6/2009 Wells
2009/0149233 A1 6/2009 Strause et al.
2009/0156297 A1 6/2009 Andersson et al.
2009/0176560 A1 7/2009 Herrmann et al.
2009/0176566 A1 7/2009 Kelly
2009/0181777 A1 7/2009 Christiani
2009/0186704 A1 7/2009 Goldberg
2009/0221355 A1 9/2009 Dunaevsky et al.
2009/0239610 A1 9/2009 Olive
2009/0247272 A1 10/2009 Abe
2009/0270164 A1 10/2009 Seelig
2009/0275393 A1 11/2009 Kisenwether
2009/0291755 A1 11/2009 Walker et al.
2009/0309305 A1 12/2009 May
2009/0312093 A1 12/2009 Walker et al.
2009/0325686 A1 12/2009 Davis
2010/0004058 A1 1/2010 Acres
2010/0016056 A1 1/2010 Thomas et al.
2010/0029373 A1 2/2010 Graham
2010/0035674 A1 2/2010 Slomiany
2010/0056247 A1 3/2010 Nicely
2010/0056260 A1 3/2010 Fujimoto
2010/0062836 A1 3/2010 Young
2010/0093420 A1 4/2010 Wright
2010/0093444 A1 4/2010 Biggar et al.
2010/0105454 A1 4/2010 Weber
2010/0120525 A1 5/2010 Baerlocher et al.
2010/0124983 A1 5/2010 Gowin et al.
2010/0137047 A1 6/2010 Englman et al.
2010/0174593 A1 7/2010 Cao
2010/0184509 A1 7/2010 Sylla et al.
2010/0203940 A1 8/2010 Alderucci et al.
2010/0210344 A1 8/2010 Edidin et al.
2010/0227672 A1 9/2010 Amour
2010/0227688 A1 9/2010 Lee
2010/0240436 A1 9/2010 Wilson et al.
2010/0285869 A1 11/2010 Walker
2010/0304825 A1 12/2010 Davis
2010/0304839 A1 12/2010 Johnson
2010/0304842 A1 12/2010 Friedman et al.
2011/0009177 A1 1/2011 Katz
2011/0009178 A1 1/2011 Gerson
2011/0045896 A1 2/2011 Sak et al.
2011/0070945 A1 3/2011 Walker
2011/0077087 A1 3/2011 Walker et al.
2011/0082571 A1 4/2011 Murdock et al.
2011/0105206 A1 5/2011 Rowe et al.
2011/0107239 A1 5/2011 Adoni
2011/0109454 A1 5/2011 McSheffrey
2011/0111820 A1 5/2011 Filipour
2011/0111837 A1 5/2011 Gagner
2011/0111841 A1 5/2011 Tessmer
2011/0118011 A1 5/2011 Filipour et al.
2011/0201413 A1 8/2011 Oberberger
2011/0207523 A1 8/2011 Filipour et al.
2011/0212766 A1 9/2011 Bowers
2011/0212767 A1 9/2011 Barclay
2011/0218028 A1 9/2011 Acres
2011/0218035 A1 9/2011 Thomas
2011/0230258 A1 9/2011 Van Luchene
2011/0230260 A1 9/2011 Morrow et al.
2011/0230267 A1 9/2011 Van Luchene
2011/0244944 A1 10/2011 Baerlocher
2011/0263312 A1 10/2011 De Waal
2011/0269522 A1 11/2011 Nicely et al.
2011/0275440 A1 11/2011 Faktor
2011/0287828 A1 11/2011 Anderson et al.
2011/0287841 A1 11/2011 Watanabe
2011/0312408 A1 12/2011 Okuaki
2011/0319169 A1 12/2011 Lam
2012/0004747 A1 1/2012 Kelly
2012/0028718 A1 2/2012 Barclay et al.
2012/0058814 A1 3/2012 Lutnick
2012/0077569 A1 3/2012 Watkins
2012/0108323 A1 5/2012 Kelly
2012/0135793 A1 5/2012 Antonopoulos
2012/0202587 A1 8/2012 Allen
2012/0302311 A1 11/2012 Luciano
2012/0322545 A1 12/2012 Arnone et al.
2013/0029760 A1 1/2013 Wickett
2013/0131848 A1 5/2013 Amone et al.
2013/0190074 A1 7/2013 Arnone et al.
2013/0260869 A1 10/2013 Leandro et al.
2014/0087801 A1 3/2014 Nicely et al.
2014/0087808 A1 3/2014 Leandro et al.
2014/0087809 A1 3/2014 Leupp et al.
2014/0094256 A1 4/2014 Hilbert
2014/0357350 A1 12/2014 Weingardt et al.
2016/0012671 A1* 1/2016 Alsip ..... G07F 17/3227 463/22
2017/0148271 A1 5/2017 Graboyes Goldman et al.

FOREIGN PATENT DOCUMENTS

JP 2004097610 A 4/2004
JP 20040097610 A1 5/2004
JP 2004166746 A 6/2004
WO 9851384 A1 11/1998
WO 2010087090 A1 8/2010
WO 2011109454 A1 9/2011
WO 2012139083 A1 10/2012
WO 2013059308 A1 4/2013

OTHER PUBLICATIONS

Changing the Virtual Self: Avatar Transformations in Popular Games; Barr et al., Victoria Univ., NZ, 2006.
Real-Time Multimodal Human-Avatar Interaction; Li et al., IEEE (Video Technology) vol. 18, No. 4, 2008.
U.S. Appl. No. 13/854,658, Arnone, et al., filed Apr. 1, 2013.
U.S. Appl. No. 13/855,676, Arnone, et al., filed Apr. 2, 2013.
U.S. Appl. No. 13/872,946, Arnone, et al., filed Apr. 29, 2013.
U.S. Appl. No. 13/886,245, Arnone, et al., filed May 2, 2013.
U.S. Appl. No. 13/888,326, Arnone, et al., filed May 6, 2013.
U.S. Appl. No. 13/890,207, Arnone, et al., filed May 8, 2013.
U.S. Appl. No. 13/896,783, Arnone, et al., filed May 17, 2013.
U.S. Appl. No. 13/898,222, Arnone, et al., filed May 20, 2013.
U.S. Appl. No. 13/900,363, Arnone, et al., filed May 22, 2013.
U.S. Appl. No. 13/903,895, Arnone, et al., filed May 28, 2013.
U.S. Appl. No. 13/917,513, Arnone, et al., filed Jun. 13, 2013.

(56) References Cited

OTHER PUBLICATIONS

U.S. Appl. No. 13/917,529, Arnone, et al., filed Jun. 13, 2013.
U.S. Appl. No. 13/920,031, Arnone, et al., filed Jun. 17, 2013.
U.S. Appl. No. 13/928,166, Arnone, et al., filed Jun. 26, 2013.
U.S. Appl. No. 13/935,410, Arnone, et al., filed Jul. 3, 2013.
U.S. Appl. No. 13/935,468, Arnone, et al., filed Jul. 3, 2013.
U.S. Appl. No. 13/686,876, Arnone, et al., filed Nov. 27, 2012.
U.S. Appl. No. 13/944,662, Arnone, et al., filed Jul. 17, 2013.
U.S. Appl. No. 13/962,815, Arnone, et al., filed Aug. 8, 2013.
U.S. Appl. No. 13/962,839, Meyerhofer, et al., filed Aug. 8, 2013.
U.S. Appl. No. 14/018,315, Arnone, et al., filed Sep. 4, 2013.
U.S. Appl. No. 14/019,384, Arnone, et al., filed Sep. 5, 2013.
U.S. Appl. No. 14/023,432, Arnone, et al., filed Sep. 10, 2013.
U.S. Appl. No. 13/600,671, Arnone, et al., filed Aug. 31, 2012.
U.S. Appl. No. 13/582,408, Arnone, et al., filed Sep. 26, 2012.
U.S. Appl. No. 13/849,458, Arnone, et al., filed Mar. 22, 2013.
U.S. Appl. No. 14/135,562, Arnone, et al., filed Dec. 19, 2013.
U.S. Appl. No. 14/080,767, Arnone, et al., filed Nov. 14, 2013.
U.S. Appl. No. 14/043,838, Arnone, et al., filed Oct. 1, 2013.
U.S. Appl. No. 14/162,735, Arnone, et al., filed Jan. 23, 2014.
U.S. Appl. No. 14/161,230, Arnone, et al., filed Jan. 22, 2014.
U.S. Appl. No. 14/083,331, Arnone, et al., filed Nov. 18, 2013.
U.S. Appl. No. 14/014,310, Arnone, et al., filed Aug. 29, 2013.
U.S. Appl. No. 14/152,953, Arnone, et al., filed Jan. 10, 2014.
U.S. Appl. No. 14/162,724, Arnone, et al., filed Jan. 23, 2014.
U.S. Appl. No. 14/104,897, Arnone, et al., filed Dec. 12, 2013.
U.S. Appl. No. 14/174,813 Arnone, et al., filed Feb. 6, 2014.
U.S. Appl. No. 14/175,986 Arnone, et al., filed Feb. 7, 2014.
U.S. Appl. No. 14/176,014 Arnone, et al., filed Feb. 7, 2014.
JU.S. Appl. No. 14/179,487 Arnone, et al., filed Feb. 12, 2014.
U.S. Appl. No. 14/179,492 Arnone, et al., filed Feb. 12, 2014.
U.S. Appl. No. 14/181,190 Arnone, et al., filed Feb. 14, 2014.
U.S. Appl. No. 14/186,393 Arnone, et al., filed Feb. 21, 2014.
U.S. Appl. No. 14/188,587 Arnone, et al., filed Feb. 24, 2014.
U.S. Appl. No. 14/185,847 Arnone, et al., filed Feb. 20, 2014.
U.S. Appl. No. 14/203,459 Arnone, et al., filed Mar. 10, 2014.
U.S. Appl. No. 14/205,272 Arnone, et al., filed Mar. 11, 2014.
WIPO—ISA, International Search Report and Written Opinion, PCT/US13/026934, dated Apr. 25, 2013.
U.S. Appl. No. 14/608,000 Arnone, et al. filed Jan. 28, 2015.
U.S. Appl. No. 14/608,087 Arnone, et al. filed Jan. 28, 2015.
U.S. Appl. No. 14/608,093 Arnone, et al. filed Jan. 28, 2015.
U.S. Appl. No. 14/610,897 Arnone, et al. filed Jan. 30, 2015.
U.S. Appl. No. 14/611,077 Arnone, et al. filed Jan. 30, 2015.
U.S. Appl. No. 14/604,629 Arnone, et al. filed Jan. 23, 2015.
U.S. Appl. No. 14/625,475 Arnone, et al. filed Feb. 18, 2015.
U.S. Appl. No. 14/617,852 Arnone, et al. filed Feb. 9, 2015.
U.S. Appl. No. 14/627,428 Arnone, et al. filed Feb. 20, 2015.
U.S. Appl. No. 14/642,427 Arnone, et al. filed Mar. 9, 2015.
U.S. Appl. No. 14/665,991 Arnone, et al. filed Mar. 23, 2015.
U.S. Appl. No. 14/666,010 Arnone, et al. filed Mar. 23, 2015.
U.S. Appl. No. 14/666,022 Arnone, et al. filed Mar. 23, 2015.
U.S. Appl. No. 14/642,623 Arnone, et al. filed Mar. 9, 2015.
U.S. Appl. No. 14/663,337 Arnone, et al. filed Mar. 19, 2015.
U.S. Appl. No. 14/666,284 Arnone, et al. filed Mar. 23, 2015.
U.S. Appl. No. 14/679,885 Arnone, et al. filed Apr. 6, 2015.
U.S. Appl. No. 14/685,378 Arnone, et al. filed Apr. 13, 2015.
U.S. Appl. No. 14/686,675 Arnone, et al. filed Apr. 14, 2015.
U.S. Appl. No. 14/686,678 Arnone, et al. filed Apr. 14, 2015.
U.S. Appl. No. 14/701,430 Arnone, et al. filed Apr. 30, 2015.
U.S. Appl. No. 14/703,721 Arnone, et al. filed May 4, 2015.
U.S. Appl. No. 14/708,138 Arnone, et al. filed May 8, 2015.
U.S. Appl. No. 14/708,141 Arnone, et al. filed May 8, 2015.
U.S. Appl. No. 14/708,160 Arnone, et al. filed May 8, 2015.
U.S. Appl. No. 14/708,161 Arnone, et al. filed May 8, 2015.
U.S. Appl. No. 14/708,162 Arnone, et al. filed May 8, 2015.
U.S. Appl. No. 14/710,483 Arnone, et al. filed May 12, 2015.
U.S. Appl. No. 14/714,084 Arnone, et al. filed May 15, 2015.
U.S. Appl. No. 14/715,463 Arnone, et al. filed May 18, 2015.
U.S. Appl. No. 14/720,620 Arnone, et al. filed May 22, 2015.
U.S. Appl. No. 14/720,624 Arnone, et al. filed May 22, 2015.
U.S. Appl. No. 14/720,626 Arnone, et al. filed May 22, 2015.
U.S. Appl. No. 14/727,726 Arnone, et al. filed Jun. 1, 2015.
U.S. Appl. No. 14/730,183 Arnone, et al. filed Jun. 3, 2015.
U.S. Appl. No. 14/731,321 Arnone, et al. filed Jun. 4, 2015.
U.S. Appl. No. 14/740,078 Arnone, et al. filed Jun. 15, 2015.
U.S. Appl. No. 14/742,517 Arnone, et al. filed Jun. 17, 2015.
U.S. Appl. No. 14/743,708 Arnone, et al. filed Jun. 18, 2015.
U.S. Appl. No. 14/746,731 Arnone, et al. filed Jun. 22, 2015.
U.S. Appl. No. 14/748,122 Arnone, et al. filed Jun. 23, 2015.
U.S. Appl. No. 14/788,581 Arnone, et al. filed Jun. 30, 2015.
U.S. Appl. No. 14/793,685 Arnone, et al. filed Jul. 7, 2015.
U.S. Appl. No. 14/793,704 Arnone, et al. filed Jul. 7, 2015.
U.S. Appl. No. 14/797,016 Arnone, et al. filed Jul. 10, 2015.
U.S. Appl. No. 14/799,481 Arnone, et al. filed Jul. 14, 2015.
U.S. Appl. No. 15/362,660 Arnone, et al. filed Nov. 28, 2016.
U.S. Appl. No. 15/365,628 Arnone, et al. filed Nov. 30, 2016.
U.S. Appl. No. 15/367,541 Arnone, et al. filed Dec. 2, 2016.
U.S. Appl. No. 15/369,394 Arnone, et al. filed Dec. 5, 2016.
U.S. Appl. No. 15/370,425 Arnone, et al. filed Dec. 6, 2016.
U.S. Appl. No. 15/375,711 Arnone, et al. filed Dec. 12, 2016.
U.S. Appl. No. 15/387,117 Arnone, et al. filed Dec. 21, 2016.
U.S. Appl. No. 15/392,887 Arnone, et al. filed Dec. 28, 2016.
U.S. Appl. No. 15/393,212 Arnone, et al. filed Dec. 28, 2016.
U.S. Appl. No. 15/394,257 Arnone, et al. filed Dec. 29, 2016.
U.S. Appl. No. 15/396,352 Arnone, et al. filed Dec. 30, 2016.
U.S. Appl. No. 15/396,354 Arnone, et al. filed Dec. 30, 2016.
U.S. Appl. No. 15/396,365 Arnone, et al. filed Dec. 30, 2016.
U.S. Appl. No. 15/406,474 Arnone, et al. filed Jan. 13, 2017.
U.S. Appl. No. 15/413,322 Arnone, et al. filed Jan. 23, 2017.
U.S. Appl. No. 15/415,833 Arnone, et al. filed Jan. 25, 2017.
U.S. Appl. No. 15/417,030 Arnone, et al. filed Jan. 26, 2017.
U.S. Appl. No. 15/422,453 Arnone, et al. filed Feb. 1, 2017.
U.S. Appl. No. 15/431,631 Arnone, et al. filed Feb. 13, 2017.
U.S. Appl. No. 15/434,843 Arnone, et al. filed Feb. 16, 2017.
U.S. Appl. No. 15/439,499 Arnone, et al. filed Feb. 22, 2017.
U.S. Appl. No. 15/449,249 Arnone, et al. filed Mar. 3, 2017.
U.S. Appl. No. 15/449,256 Arnone, et al. filed Mar. 3, 2017.
U.S. Appl. No. 15/450,287 Arnone, et al. filed Mar. 6, 2017.
U.S. Appl. No. 15/456,079 Arnone, et al. filed Mar. 10, 2017.
U.S. Appl. No. 15/457,827 Arnone, et al. filed Mar. 13, 2017.
U.S. Appl. No. 15/458,490 Arnone, et al. filed Mar. 14, 2017.
U.S. Appl. No. 15/460,195 Arnone, et al. filed Mar. 15, 2017 (Applicant believes reference available to Examiner iia Pair).
U.S. Appl. No. 15/463,725 Arnone, et al. filed Mar. 20, 2017.
U.S. Appl. No. 15/464,282 Arnone, et al. filed Mar. 20, 2017.
U.S. Appl. No. 15/465,521 Arnone, et al. filed Mar. 21, 2017.
U.S. Appl. No. 15/470,869 Arnone, et al. filed Mar. 27, 2017.
U.S. Appl. No. 15/473,523 Arnone, et al. filed Mar. 29, 2017.
U.S. Appl. No. 15/483,773 Arnone, et al. filed Apr. 10, 2017.
U.S. Appl. No. 15/489,343 Arnone, et al. filed Apr. 17, 2017.
U.S. Appl. No. 15/491,617 Arnone, et al. filed Apr. 19, 2017.
U.S. Appl. No. 15/583,295 Arnone, et al. filed May 1, 2017, 2017.
U.S. Appl. No. 15/589,780 Arnone, et al. filed May 8, 2017.
U.S. Appl. No. 15/597,123 Arnone, et al. filed May 16, 2017.
U.S. Appl. No. 15/597,812 Arnone, et al. filed May 17, 2017.
U.S. Appl. No. 15/599,590 Arnone, et al. filed May 19, 2017.
U.S. Appl. No. 15/605,688 Arnone, et al. filed May 25, 2017.
U.S. Appl. No. 15/605,705 Arnone, et al. filed May 25, 2017.
U.S. Appl. No. 15/626,754 Arnone, et al. filed Jun. 19, 2017.
U.S. Appl. No. 15/631,762 Arnone, et al. filed Jun. 23, 2017.
U.S. Appl. No. 15/632,478 Arnone, et al. filed Jun. 26, 2017.
U.S. Appl. No. 15/632,479 Arnone, et al. filed Jun. 26, 2017.
U.S. Appl. No. 15/632,943 Arnone, et al. filed Jun. 26, 2017.
U.S. Appl. No. 15/632,950 Arnone, et al. filed Jun. 26, 2017.
U.S. Appl. No. 15/641,119 Arnone, et al. filed Jul. 3, 2017.
U.S. Appl. No. 14/815,764 Arnone, et al. filed Jul. 31, 2015.
U.S. Appl. No. 14/815,774 Arnone, et al. filed Jul. 31, 2015.
U.S. Appl. No. 14/817,032 Arnone, et al. filed Aug. 3, 2015.
U.S. Appl. No. 14/822,890 Arnone, et al. filed Aug. 10, 2015.
U.S. Appl. No. 14/823,951 Arnone, et al. filed Aug. 11, 2015.
U.S. Appl. No. 14/823,987 Arnone, et al. filed Aug. 11, 2015.
U.S. Appl. No. 14/825,056 Arnone, et al. filed Aug. 12, 2015.

(56) References Cited

OTHER PUBLICATIONS

U.S. Appl. No. 14/835,590 Arnone, et al. filed Aug. 25, 2015.
U.S. Appl. No. 14/836,902 Arnone, et al. filed Aug. 26, 2015.
U.S. Appl. No. 14/839,647 Arnone, et al. filed Aug. 28, 2015.
U.S. Appl. No. 14/842,684 Arnone, et al. filed Sep. 1, 2015.
U.S. Appl. No. 14/842,785 Arnone, et al. filed Sep. 1, 2015.
U.S. Appl. No. 14/854,021 Arnone, et al. filed Sep. 14, 2015.
U.S. Appl. No. 14/855,322 Arnone, et al. filed Sep. 15, 2015.
U.S. Appl. No. 14/859,065 Arnone, et al. filed Sep. 18, 2015.
U.S. Appl. No. 14/865,422 Arnone, et al. filed Sep. 25, 2015.
U.S. Appl. No. 14/867,809 Arnone, et al. filed Sep. 28, 2015.
U.S. Appl. No. 14/868,287 Arnone, et al. filed Sep. 28, 2015.
U.S. Appl. No. 14/868,364 Arnone, et al. filed Sep. 28, 2015.
U.S. Appl. No. 14/869,809 Arnone, et al. filed Sep. 29, 2015.
U.S. Appl. No. 14/869,819 Arnone, et al. filed Sep. 29, 2015.
U.S. Appl. No. 14/885,894 Arnone, et al. filed Oct. 16, 2015.
U.S. Appl. No. 14/919,665 Arnone, et al. filed Oct. 21, 2015.
U.S. Appl. No. 14/942,844 Arnone, et al. filed Nov. 16, 2015.
U.S. Appl. No. 14/942,883 Arnone, et al. filed Nov. 16, 2015.
U.S. Appl. No. 14/949,759 Arnone, et al. filed Nov. 23, 2015.
U.S. Appl. No. 14/952,758 Arnone, et al. filed Nov. 25, 2015.
U.S. Appl. No. 14/952,769 Arnone, et al. filed Nov. 25, 2015.
U.S. Appl. No. 14/954,922 Arnone, et al. filed Nov. 30, 2015.
U.S. Appl. No. 14/954,931 Arnone, et al. filed Nov. 30, 2015.
U.S. Appl. No. 14/955,000 Arnone, et al. filed Nov. 30, 2015.
U.S. Appl. No. 14/956,301 Arnone, et al. filed Dec. 1, 2015.
U.S. Appl. No. 14/965,231 Arnone, et al. filed Dec. 10, 2015.
U.S. Appl. No. 14/965,846 Arnone, et al. filed Dec. 10, 2015.
U.S. Appl. No. 14/981,640 Arnone, et al. filed Dec. 28, 2015.
U.S. Appl. No. 14/981,775 Arnone, et al. filed Dec. 28, 2015.
U.S. Appl. No. 14/984,943 Arnone, et al. filed Dec. 30, 2015.
U.S. Appl. No. 14/984,965 Arnone, et al. filed Dec. 30, 2015.
U.S. Appl. No. 14/984,978 Arnone, et al. filed Dec. 30, 2015.
U.S. Appl. No. 14/985,107 Arnone, et al. filed Dec. 30, 2015.
U.S. Appl. No. 14/995,151 Arnone, et al. filed Jan. 13, 2016.
U.S. Appl. No. 14/974,432 Arnone, et al. filed Dec. 18, 2015.
U.S. Appl. No. 14/997,413 Arnone, et al. filed Jan. 15, 2016.
U.S. Appl. No. 15/002,233 Arnone, et al. filed Jan. 20, 2016.
U.S. Appl. No. 15/005,944 Arnone, et al. filed Jan. 25, 2016.
U.S. Appl. No. 15/011,322 Arnone, et al. filed Jan. 29, 2016.
U.S. Appl. No. 15/051,535 Arnone, et al. filed Feb. 23, 2016.
U.S. Appl. No. 15/053,236 Arnone, et al. filed Feb. 25, 2016.
U.S. Appl. No. 15/057,095 Arnone, et al. filed Feb. 29, 2016.
U.S. Appl. No. 15/060,502 Arnone, et al. filed Mar. 3, 2016.
U.S. Appl. No. 15/920,390 Arnone, et al. filed Mar. 13, 2018.
U.S. Appl. No. 15/922,816 Arnone, et al. filed Mar. 15, 2018.
U.S. Appl. No. 15/922,905 Arnone, et al. filed Mar. 15, 2018.
U.S. Appl. No. 15/925,268 Arnone, et al. filed Mar. 19, 2018.
U.S. Appl. No. 15/925,751 Arnone, et al. filed Mar. 19, 2018.
U.S. Appl. No. 15/933,319 Arnone, et al. filed Mar. 22, 2018.
U.S. Appl. No. 15/935,956 Arnone, et al. filed Mar. 26, 2018.
U.S. Appl. No. 15/943,207 Arnone, et al. filed Apr. 2, 2018.
U.S. Appl. No. 15/948,607 Arnone, et al. filed Apr. 9, 2018.
U.S. Appl. No. 15/949,812 Arnone, et al. filed Apr. 10, 2018.
U.S. Appl. No. 15/951,155 Arnone, et al. filed Apr. 11, 2018.
U.S. Appl. No. 15/954,094 Arnone, et al. filed Apr. 16, 2018.
U.S. Appl. No. 15/954,136 Arnone, et al. filed Apr. 16, 2018.
U.S. Appl. No. 15/961,375 Arnone, et al. filed Apr. 24, 2018.
U.S. Appl. No. 15/961,382 Arnone, et al. filed Apr. 24, 2018.
U.S. Appl. No. 15/966,590 Arnone, et al. filed Apr. 30, 2018.
U.S. Appl. No. 15/968,723 Arnone, et al. filed May 1, 2018.
U.S. Appl. No. 15/971,288 Arnone, et al. filed May 4, 2018.
U.S. Appl. No. 15/978,087 Arnone, et al. filed May 11, 2018.
U.S. Appl. No. 15/979,391 Arnone, et al. filed May 14, 2018.
U.S. Appl. No. 15/651,934 Arnone, et al. filed Jul. 17, 2017.
U.S. Appl. No. 15/657,826 Arnone, et al. filed Jul. 24, 2017.
U.S. Appl. No. 15/657,835 Arnone, et al. filed Jul. 24, 2017.
U.S. Appl. No. 15/664,535 Arnone, et al. filed Jul. 31, 2017.
U.S. Appl. No. 15/667,168 Arnone, et al. filed Aug. 2, 2017.
U.S. Appl. No. 15/267,511 Rowe, filed Sep. 16, 2016.
U.S. Appl. No. 15/681,966 Arnone, et al. filed Aug. 21, 2017.
U.S. Appl. No. 15/681,970 Arnone, et al. filed Aug. 21, 2017.
U.S. Appl. No. 15/681,978 Arnone, et al. filed Aug. 21, 2017.
U.S. Appl. No. 15/687,922 Arnone, et al. filed Aug. 28, 2017.
U.S. Appl. No. 15/687,927 Arnone, et al. filed Aug. 28, 2017.
U.S. Appl. No. 15/694,520 Arnone, et al. filed Sep. 1, 2017.
U.S. Appl. No. 15/694,738 Arnone, et al. filed Sep. 1, 2017.
U.S. Appl. No. 15/713,595 Arnone, et al. filed Sep. 22, 2017.
U.S. Appl. No. 15/715,144 Arnone, et al. filed Sep. 25, 2017.
U.S. Appl. No. 15/716,317 Arnone, et al. filed Sep. 26, 2017.
U.S. Appl. No. 15/716,318 Arnone, et al. filed Sep. 26, 2017.
U.S. Appl. No. 15/728,096 Arnone, et al. filed Oct. 9, 2017.
U.S. Appl. No. 15/784,961 Arnone, et al. filed Oct. 16, 2017.
U.S. Appl. No. 15/790,482 Arnone, et al. filed Oct. 23, 2017.
U.S. Appl. No. 15/794,712 Arnone, et al. filed Oct. 26, 2017.
U.S. Appl. No. 15/797,571 Arnone, et al. filed Oct. 30, 2017.
U.S. Appl. No. 15/804,413 Arnone, et al. filed Nov. 6, 2017.
U.S. Appl. No. 15/811,412 Arnone, et al. filed Nov. 13, 2017.
U.S. Appl. No. 15/811,419 Arnone, et al. filed Nov. 13, 2017.
U.S. Appl. No. 15/815,629 Arnone, et al. filed Nov. 16, 2017.
U.S. Appl. No. 15/822,908 Arnone, et al. filed Nov. 27, 2017.
U.S. Appl. No. 15/822,912 Arnone, et al. filed Nov. 27, 2017.
U.S. Appl. No. 15/830,614 Arnone, et al. filed Dec. 4, 2017.
U.S. Appl. No. 15/834,006 Arnone, et al. filed Dec. 6, 2017.
U.S. Appl. No. 15/837,795 Arnone, et al. filed Dec. 11, 2017.
U.S. Appl. No. 15/845,433 Arnone, et al. filed Dec. 18, 2017.
U.S. Appl. No. 15/858,817 Arnone, et al. filed Dec. 29, 2017.
U.S. Appl. No. 15/858,826 Arnone, et al. filed Dec. 29, 2017.
U.S. Appl. No. 15/862,329 Arnone, et al. filed Jan. 4, 2018.
U.S. Appl. No. 15/864,737 Arnone, et al. filed Jan. 8, 2018.
U.S. Appl. No. 15/882,328 Arnone, et al. filed Jan. 29, 2018.
U.S. Appl. No. 15/882,333 Arnone, et al. filed Jan. 29, 2018.
U.S. Appl. No. 15/882,428 Arnone, et al. filed Jan. 29, 2018.
U.S. Appl. No. 15/882,447 Arnone, et al. filed Jan. 29, 2018.
U.S. Appl. No. 15/882,850 Arnone, et al. filed Jan. 29, 2018.
U.S. Appl. No. 15/882,902 Arnone, et al. filed Jan. 29, 2018.
U.S. Appl. No. 15/888,512 Arnone, et al. filed Feb. 5, 2018.
U.S. Appl. No. 15/894,398 Arnone, et al. filed Feb. 12, 2018.
U.S. Appl. No. 15/912,019 Arnone, et al. filed Mar. 5, 2018.
U.S. Appl. No. 15/912,026 Arnone, et al. filed Mar. 5, 2018.
U.S. Appl. No. 15/912,529 Arnone, et al. filed Mar. 5, 2018.
U.S. Appl. No. 15/920,374 Arnone, et al. filed Mar. 13, 2018.
U.S. Appl. No. 15/920,380 Arnone, et al. filed Mar. 13, 2018.
U.S. Appl. No. 15/920,388 Arnone, et al. filed Mar. 13, 2018.
U.S. Appl. No. 14/205,303 Arnone, et al., filed Mar. 11, 2014.
U.S. Appl. No. 14/205,306 Arnone, et al., filed Mar. 11, 2014.
U.S. Appl. No. 14/209,485 Arnone, et al., filed Mar. 13, 2014.
U.S. Appl. No. 14/214,310 Arnone, et al., filed Mar. 14, 2014.
U.S. Appl. No. 14/222,520 Arnone, et al., filed Mar. 21, 2014.
U.S. Appl. No. 14/253,813 Arnone, et al., filed Apr. 15, 2014.
U.S. Appl. No. 14/255,253 Arnone, et al., filed Apr. 17, 2014.
U.S. Appl. No. 14/255,919 Arnone, et al. filed Apr. 17, 2014.
U.S. Appl. No. 14/263,988 Arnone, et al. filed Apr. 28, 2014.
U.S. Appl. No. 14/270,335 Arnone, et al. filed May 5, 2014.
U.S. Appl. No. 14/271,360 Arnone, et al. filed May 6, 2014.
U.S. Appl. No. 13/961,849 Arnone, et al. filed Aug. 7, 2013.
U.S. Appl. No. 13/746,850 Arnone, et al. filed Jan. 22, 2013.
U.S. Appl. No. 14/288,169 Arnone, et al. filed May 27, 2014.
U.S. Appl. No. 14/304,027 Arnone, et al. filed Jun. 13, 2014.
U.S. Appl. No. 14/306,187 Arnone, et al. filed Jun. 16, 2014.
U.S. Appl. No. 14/312,623 Arnone, et al. filed Jun. 24, 2014.
U.S. Appl. No. 14/330,249 Arnone, et al. filed Jul. 14, 2014.
U.S. Appl. No. 14/339,142 Arnone, et al. filed Jul. 23, 2014.
U.S. Appl. No. 14/458,206 Arnone, et al. filed Aug. 12, 2014.
U.S. Appl. No. 14/461,344 Arnone, et al. filed Aug. 15, 2014.
U.S. Appl. No. 14/462,516 Arnone, et al. filed Aug. 18, 2014.
U.S. Appl. No. 14/467,646 Meyerhofer, et al. filed Aug. 25, 2014.
U.S. Appl. No. 14/474,023 Arnone, et al. filed Aug. 29, 2014.
U.S. Appl. No. 14/486,895 Arnone, et al. filed Sep. 15, 2014.
U.S. Appl. No. 14/507,206 Arnone, et al. filed Oct. 6, 2014.
U.S. Appl. No. 14/521,338 Arnone, et al. filed Oct. 22, 2014.
U.S. Appl. No. 14/535,808 Arnone, et al. filed Nov. 7, 2014.
U.S. Appl. No. 14/535,816 Arnone, et al. filed Nov. 7, 2014.

(56) References Cited

OTHER PUBLICATIONS

U.S. Appl. No. 14/536,231 Arnone, et al. filed Nov. 7, 2014.
U.S. Appl. No. 14/536,280 Arnone, et al. filed Nov. 7, 2014.
U.S. Appl. No. 14/549,137 Arnone, et al. filed Nov. 20, 2014.
U.S. Appl. No. 14/550,802 Arnone, et al. filed Nov. 21, 2014.
U.S. Appl. No. 14/555,401 Arnone, et al. filed Nov. 26, 2014.
U.S. Appl. No. 14/559,840 Arnone, et al. filed Dec. 3, 2014.
U.S. Appl. No. 14/564,834 Arnone, et al. filed Dec. 9, 2014.
U.S. Appl. No. 14/570,746 Arnone, et al. filed Dec. 15, 2014.
U.S. Appl. No. 14/570,857 Arnone, et al. filed Dec. 15, 2014.
U.S. Appl. No. 14/586,626 Arnone, et al. filed Dec. 30, 2014.
U.S. Appl. No. 14/586,639 Arnone, et al. filed Dec. 30, 2014.
U.S. Appl. No. 14/586,645 Arnone, et al. filed Dec. 30, 2014.
U.S. Appl. No. 14/598,151 Arnone, et al. filed Jan. 15, 2015.
U.S. Appl. No. 14/601,063 Arnone, et al. filed Jan. 20, 2015.
U.S. Appl. No. 14/601,108 Arnone, et al. filed Jan. 20, 2015.
IP Australia, Patent Examination Report No. 1, Patent Application No. 2015227395, dated Jun. 2, 2016.
U.S. Appl. No. 15/063,365 Arnone, et al. filed Mar. 7, 2016.
U.S. Appl. No. 15/063,496 Arnone, et al. filed Mar. 7, 2016.
U.S. Appl. No. 15/073,602 Arnone, et al. filed Mar. 17, 2016.
U.S. Appl. No. 15/074,999 Arnone, et al. filed Mar. 18, 2016.
U.S. Appl. No. 15/077,574 Arnone, et al. filed Mar. 22, 2016.
U.S. Appl. No. 15/083,284 Arnone, et al. filed Mar. 28, 2016.
U.S. Appl. No. 15/091,395 Arnone, et al. filed Apr. 5, 2016.
U.S. Appl. No. 15/093,685 Arnone, et al. filed Apr. 7, 2016.
U.S. Appl. No. 15/098,287 Arnone, et al. filed Apr. 13, 2016.
U.S. Appl. No. 15/098,313 Arnone, et al. filed Apr. 13, 2016.
U.S. Appl. No. 15/130,101 Arnone, et al. filed Apr. 15, 2016.
U.S. Appl. No. 15/133,624 Arnone, et al. filed Apr. 20, 2016.
U.S. Appl. No. 15/134,852 Arnone, et al. filed Apr. 21, 2016.
U.S. Appl. No. 15/139,148 Arnone, et al. filed Apr. 26, 2016.
U.S. Appl. No. 15/141,784 Arnone, et al. filed Apr. 29, 2016.
U.S. Appl. No. 15/155,107 Arnone, et al. filed May 16, 2016.
U.S. Appl. No. 15/156,222 Arnone, et al. filed May 16, 2016.
U.S. Appl. No. 15/158,530 Arnone, et al. filed May 18, 2016.
U.S. Appl. No. 15/161,174 Arnone, et al. filed May 20, 2016.
U.S. Appl. No. 15/170,773 Arnone, et al. filed Jun. 1, 2016.
U.S. Appl. No. 15/174,995 Arnone, et al. filed Jun. 6, 2016.
U.S. Appl. No. 15/179,940 Arnone, et al. filed Jun. 10, 2016.
U.S. Appl. No. 15/189,797 Arnone, et al. filed Jun. 22, 2016.
U.S. Appl. No. 15/190,745 Arnone, et al. filed Jun. 23, 2016.
U.S. Appl. No. 15/191,050 Arnone, et al. filed Jun. 23, 2016.
U.S. Appl. No. 15/219,257 Arnone, et al. filed Jul. 25, 2016.
U.S. Appl. No. 15/227,881 Arnone, et al. filed Aug. 3, 2016.
U.S. Appl. No. 15/241,683 Arnone, et al. filed Aug. 19, 2016.
U.S. Appl. No. 15/245,040 Arnone, et al. filed Aug. 23, 2016.
U.S. Appl. No. 15/233,294 Arnone, et al. filed Aug. 24, 2016.
U.S. Appl. No. 15/252,190 Arnone, et al. filed Aug. 30, 2016.
U.S. Appl. No. 15/255,789 Arnone, et al. filed Sep. 2, 2016.
U.S. Appl. No. 15/261,858 Arnone, et al. filed Sep. 9, 2016.
U.S. Appl. No. 15/264,521 Arnone, et al. filed Sep. 13, 2016.
U.S. Appl. No. 15/264,557 Arnone, et al. filed Sep. 13, 2016.
U.S. Appl. No. 15/271,214 Arnone, et al. filed Sep. 20, 2016.
U.S. Appl. No. 15/272,318 Arnone, et al. filed Sep. 21, 2016.
U.S. Appl. No. 15/273,260 Arnone, et al. filed Sep. 22, 2016.
U.S. Appl. No. 15/276,469 Arnone, et al. filed Sep. 26, 2016.
U.S. Appl. No. 15/280,255 Arnone, et al. filed Sep. 29, 2016.
U.S. Appl. No. 15/286,922 Arnone, et al. filed Oct. 6, 2016.
U.S. Appl. No. 15/287,129 Arnone, et al. filed Oct. 6, 2016.
U.S. Appl. No. 15/289,648 Arnone, et al. filed Oct. 10, 2016.
U.S. Appl. No. 15/297,019 Arnone, et al. filed Oct. 18, 2016.
U.S. Appl. No. 15/298,533 Arnone, et al. filed Oct. 20, 2016.
U.S. Appl. No. 15/336,696 Arnone, et al. filed Oct. 27, 2016.
U.S. Appl. No. 15/339,898 Arnone, et al. filed Oct. 31, 2016.
U.S. Appl. No. 15/345,451 Arnone, et al. filed Nov. 7, 2016.
U.S. Appl. No. 15/362,214 Arnone, et al. filed Nov. 28, 2016.

* cited by examiner

INSURANCE ENABLED HYBRID GAMING SYSTEM

CROSS REFERENCE TO RELATED APPLICATIONS

This application is a continuation of U.S. patent application Ser. No. 15/170,773 filed on Jun. 1, 2016, which is a continuation of U.S. patent application Ser. No. 14/604,629 filed on Jan. 23, 2015, and issued as U.S. Pat. No. 9,361,758 on Jun. 7, 2016, which is a continuation of U.S. patent application Ser. No. 14/458,206 filed on Aug. 12, 2014 and issued as U.S. Pat. No. 8,951,113, on Feb. 10, 2015, which is a continuation of U.S. patent application Ser. No. 14/179,492 filed on Feb. 12, 2014 and issued as U.S. Pat. No. 8,808,086 on Aug. 19, 2014, which is a continuation of Patent Cooperation Treaty Application No. PCT/US13/026934 filed on Feb. 20, 2013 which claims the benefit of U.S. Provisional Patent Application No. 61/601,708 filed on Feb. 22, 2012, the contents of each of which are hereby incorporated by reference in their entirety as if stated in full herein. This application references Patent Cooperation Treaty Application No. PCT/US11/26768, filed Mar. 1, 2011, U.S. Provisional Patent Application No. 61/459,131, filed Dec. 6, 2010, U.S. Provisional Patent Application No. 61/460,362, filed Dec. 31, 2010, U.S. Provisional Patent Application No. 61/574,753, filed Aug. 9, 2011, Patent Cooperation Treaty Application No. PCT/US11/63587, filed Dec. 6, 2011, U.S. Provisional Patent Application titled "USE OF VARIOUS CONTROL ELEMENTS IN AN HYBRID GAME" filed on Dec. 9, 2011, and U.S. Provisional Patent Application titled "INITIATION MODES FOR HYBRID GAME" filed on Jan. 5, 2012, the contents of each of which are hereby incorporated by reference in their entirety as if stated in full herein.

FIELD OF THE INVENTION

Embodiments of the present invention are generally related to gaming and more specifically to insurance enabled hybrid games that include both an entertainment game and a gambling game capable of applying insurance safeguards to insurance enabled hybrid game gameplay that mitigates negative outcomes.

BACKGROUND

The gaming machine manufacturing industry has traditionally developed gaming machines with a gambling game. A gambling game is typically a game of chance, which is a game where the outcome of the game is generally dependent solely on chance (such as a slot machine). A game of chance can be contrasted with a game of skill where the outcome of the game may depend upon a player's skill with the game. Gambling games are typically not as interactive and do not include graphics as sophisticated as an entertainment game, which is a game of skill such as a video game.

SUMMARY OF THE INVENTION

Systems in accordance with embodiments of the invention operate an insurance enabled hybrid gaming system. One embodiment includes a terminal with an entertainment software engine constructed to receive from a player a contribution of a credit and provide an entertainment game. The hybrid gaming system also includes a real world engine constructed to provide a gambling game in which the credit is wagered. The hybrid gaming system also includes a game world engine connecting the entertainment software engine and the real world engine using a network, the game world engine configured to: receive, from the entertainment software engine, a gameplay gambling event occurrence based upon a player's skillful execution of the entertainment game that triggers a wager in a gambling game; communicate, to the real world engine, the gameplay gambling event occurrence; activate an insurance proposition associated with an insurance trigger event in accordance with an insurance activation rule to generate at least one insurance relationship between an insurance safeguard that can be applied in response to a negative outcome of a challenge of the entertainment game in exchange for an insurance fee, where an insurance relationship can be applied in accordance with an insurance proposition rule, and where the challenge is a gameplay event of the entertainment game dependent upon player action and the negative outcome is an outcome of the challenge defined by the insurance safeguard; communicate, to the real world engine, an indication to collect an insurance fee from a player profile in accordance with the insurance proposition rule; and communicate, to the entertainment software engine, an insurance safeguard associated with the collected insurance fee in accordance with the insurance proposition rule, in response to a negative outcome of the challenge detected by the insurance module that mitigates the negative outcome.

In a further embodiment, the game world engine monitors insurance enabled hybrid gaming system gameplay using the insurance activation rule for the insurance trigger event.

In a further embodiment, an insurance database is used to store information accessible to the game world engine selected from the group consisting of: insurance trigger events, insurance relationships and insurance proposition rules.

In a further embodiment, the insurance proposition generates at least one insurance relationship by retrieving at least one insurance relationship from an insurance database utilizing metadata that identifies an insurance trigger event.

In a further embodiment, the insurance proposition rule includes receipt of an acceptance of an insurance relationship from a user interface associated with the player in order to collect the insurance fee from the player profile.

In a further embodiment, the insurance proposition rule includes collection of the insurance fee from the player profile in order to apply the insurance safeguard.

In a further embodiment, the insurance trigger event is a configuration of gameplay resources present in an insurance enabled hybrid gaming system gameplay session associated with a player selected from the group consisting of: real world credits, game world credits and elements, where elements are a limited resource consumed within the entertainment game to advance entertainment game gameplay.

In a further embodiment, the insurance fee includes an amount of gameplay resources selected from the group consisting of: real world credits, game world credits and elements, where elements are a limited resource consumed within the entertainment game to advance entertainment game gameplay.

In a further embodiment, the insurance safeguard is a payout of gameplay resources to a player, where the gameplay resources are selected from the group consisting of: real world credits, game world credits and elements, where elements are a limited resource consumed within the entertainment game to advance entertainment game gameplay.

In a further embodiment, the insurance safeguard rolls back entertainment game gameplay progression to a point prior to the outcome of the challenge.

In a further embodiment, the insurance safeguard rolls back entertainment game gameplay progression by recording game state data that can be utilized to recreate the entertainment game at a point prior to the outcome of the challenge and restarting the entertainment game configured with the game state data to recreate entertainment game gameplay at the point prior to the outcome of the challenge.

In a further embodiment, the insurance safeguard advances a player in the entertainment game to a point beyond the challenge.

In a further embodiment, the insurance safeguard advances a player to a point beyond the challenge by storing game state data that can be utilized to execute the entertainment game at a point past the outcome of the challenge and restarting the entertainment game configured with the game state data to recreate entertainment game gameplay at the point past the challenge.

In a further embodiment, a player of an insurance enabled hybrid gaming system is an electronic representation of interactions associated with a player profile of the insurance enabled hybrid gaming system.

Another embodiment includes an insurance enabled hybrid gaming system, including: a real world engine constructed to provide a gambling game, the gambling game providing a randomly generated payout of real world credits from the wager of real world credits in the gambling game; a game world engine connecting the real world engine to an entertainment software engine using a network, the entertainment software engine providing an entertainment game and the game world engine configured to: receive, from the entertainment software engine, a gameplay gambling event occurrence based upon a player's skillful execution of the entertainment game that triggers a wager in a gambling game; communicate, to the real world engine, the gameplay gambling event occurrence; activate an insurance proposition associated with an insurance trigger event in accordance with an insurance activation rule to generate at least one insurance relationship between an insurance safeguard that can be applied in response to a negative outcome of a challenge of the entertainment game in exchange for an insurance fee, where an insurance relationship can be applied in accordance with an insurance proposition rule, and where the challenge is a gameplay event of the entertainment game dependent upon player action and the negative outcome is an outcome of the challenge defined by the insurance safeguard; communicate, to the real world engine, an indication to collect an insurance fee from a player profile in accordance with the insurance proposition rule; and communicate, to the entertainment software engine, an insurance safeguard associated with the collected insurance fee in accordance with the insurance proposition rule, in response to a negative outcome of the challenge detected by the insurance module that mitigates the negative outcome.

Another embodiment includes an insurance enabled hybrid gaming system, including: an entertainment software engine constructed to provide an entertainment game; a game world engine connecting the entertainment software engine to a real world engine using a network, the real world engine providing a gambling game and the game world engine configured to: receive, from the entertainment software engine, a gameplay gambling event occurrence based upon a player's skillful execution of the entertainment game that triggers a wager in a gambling game; communicate, to the real world engine, the gameplay gambling event occurrence; activate an insurance proposition associated with an insurance trigger event in accordance with an insurance activation rule to generate at least one insurance relationship between an insurance safeguard that can be applied in response to a negative outcome of a challenge of the entertainment game in exchange for an insurance fee, where an insurance relationship can be applied in accordance with an insurance proposition rule, and where the challenge is a gameplay event of the entertainment game dependent upon player action and the negative outcome is an outcome of the challenge defined by the insurance safeguard; communicate, to the real world engine, an indication to collect an insurance fee from a player profile in accordance with the insurance proposition rule; and communicate, to the entertainment software engine, an insurance safeguard associated with the collected insurance fee in accordance with the insurance proposition rule, in response to a negative outcome of the challenge detected by the insurance module that mitigates the negative outcome.

DETAILED DESCRIPTION

Figure 1:
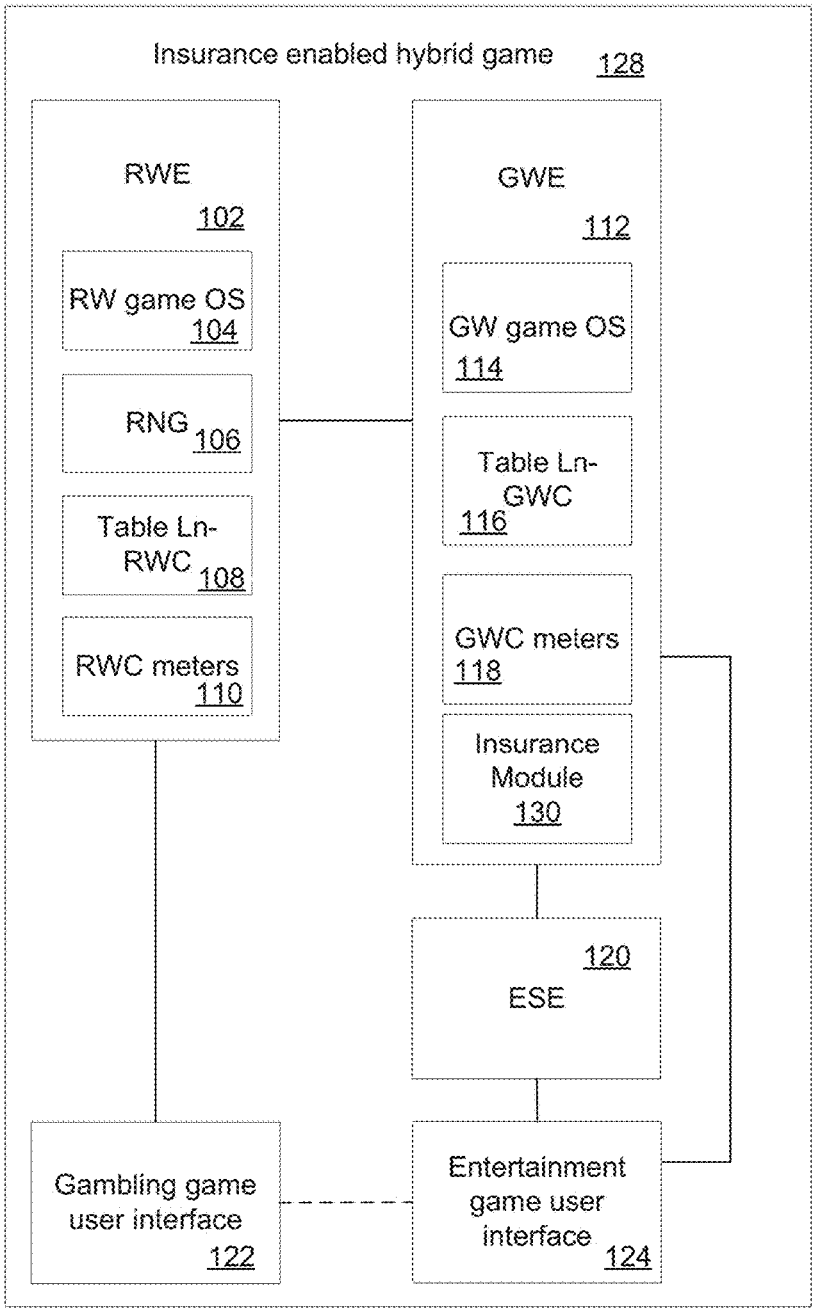
FIG. 1 illustrates an insurance enabled hybrid game in accordance with an embodiment of the invention.

Turning now to the drawings, systems and methods for operation of insurance enabled hybrid games are illustrated.

In several embodiments, an insurance enabled hybrid game is a form of a hybrid game that integrates an insurance module with both a gambling game that includes a real world engine (RWE) which manages the gambling game, as well as an entertainment game that includes a game world engine (GWE) which manages the entertainment portion of a game, and an entertainment software engine (ESE) which executes the entertainment game for user entertainment. In certain embodiments, the insurance enabled hybrid game also includes a user interface associated with either or both the gambling game and the entertainment game. A player of an insurance enabled hybrid game is the electronic representation of interactions, typically via a user interface, associated with a player profile of the insurance enabled hybrid game. In operation of an insurance enabled hybrid game, a player acts upon various types of elements of the entertainment game in a game world environment. Elements are a limited resource consumed within an entertainment game to advance entertainment game gameplay. In playing the entertainment game using the elements, a player can (optionally) consume and accrue game world credits (GWC) within the entertainment game. These credits can be in the form of (but are not limited to) game world objects, experience points, or points generally. Wagers are made in the gambling game using real world credits (RWC). The real world credits can be credits in an actual currency, or may be credits in a virtual currency which has real world value. Gambling outcomes from the gambling game may cause consumption, loss or accrual of RWC. In addition, gambling outcomes in the gambling game may influence elements in the entertainment game such as (but not limited to) by restoring a consumed element, causing the loss of an element, restoration or placement of a fixed element. In certain embodiments, gambling games can facilitate the wager of GWC for a randomly generated payout of GWC or a wager of elements for a randomly generated payout of elements. In particular embodiments, an amount of GWC and/or elements used as part of a wager can have a RWC value if cashed out of an insurance enabled hybrid game gameplay session. Example elements include enabling elements (EE) which are elements that enable a player's play of the entertainment game and whose consumption by the player while playing the entertainment game may trigger a wager in a gambling game. Another example of an element is a reserve enabling element (REE), which is an element that converts into one or more enabling elements upon occurrence of a release event in transportable variable hybrid game gameplay. Other types of elements include actionable elements (AE) which are elements that are acted upon to trigger a wager in the gambling game and may not be restorable during normal play of the entertainment game. In progressing through entertainment game gameplay, elements can be utilized by a player during interactions with a controlled entity (CE) which is a character, entity, inanimate object, device or other object under control of a player. Also, entertainment game gameplay progress can be dependent upon: a required object (RO) which is a specific object in an entertainment game acted upon for an AE to be completed (such as but not limited to a specific key needed to open a door); a required environmental condition (REC) which is a game state present within an entertainment game for an AE to be completed (such as but not limited to daylight whose presence enables a character to walk through woods); or a controlled entity characteristic (CEC) which is a status of the CE within an entertainment game for an AE to be completed (such as but not limited to a CE to have full health points before entering battle). Various hybrid games are discussed in Patent Cooperation Treaty Application No. PCT/US11/26768, filed Mar. 1, 2011, entitled ENRICHED GAME PLAY ENVIRONMENT (SINGLE and/or MULTI-PLAYER) FOR CASINO APPLICATIONS and Patent Cooperation Treaty Application No. PCT/US11/63587, filed Dec. 6, 2011, entitled ENHANCED SLOT-MACHINE FOR CASINO APPLICATIONS each disclosure of which is hereby incorporated by reference in its entirety.

In many embodiments, an insurance enabled hybrid game is a hybrid game with an insurance module constructed to implement an insurance safeguard that mitigates a negative outcome from a challenge presented during insurance enabled hybrid game gameplay. In several embodiments, an insurance module can monitor insurance enabled hybrid game gameplay for an insurance trigger event to activate an insurance proposition in accordance with an insurance activation rule. An insurance proposition associated with a detected insurance trigger event can generate at least one insurance relationship between an insurance fee collected from a player profile and an insurance safeguard whose application mitigates the effect of a negative outcome from a challenge during entertainment game gameplay that can be applied in accordance with an insurance proposition rule. The insurance module can collect an insurance fee associated with the insurance relationship from a player account accessible during execution of the entertainment game in accordance with the insurance proposition rule. The insurance module can also apply an insurance safeguard associated with a collected insurance fee in accordance with the insurance proposition rule by altering insurance enabled hybrid game gameplay in response a negative outcome of a challenge detected by the insurance module that mitigates the negative outcome.

In many embodiments, an insurance activation rule can be retrieved from an insurance database and utilized by the insurance module in monitoring information generated during insurance enabled hybrid game gameplay for an insurance trigger event. An insurance trigger event can be a particular entertainment game gameplay event (such as but not limited to a challenge) or particular configurations of gameplay resources (such as but not limited to RWC, GWC or elements) utilized to advance gameplay detected in an entertainment game gameplay session.

In several embodiments, an insurance proposition generates at least one insurance relationship in accordance with a specific insurance trigger event detected. The insurance relationship can be presented in a user interface associated with a player. An insurance relationship can be applied upon acceptance of the insurance relationship by the player using the user interface in accordance with an insurance proposition rule. In various embodiments, an insurance fee is an amount of gameplay resources that can be collected from a player profile such as but not limited to real world credits, game world credits and elements.

In a number of embodiments, an insurance safeguard is applied by altering insurance enabled hybrid game gameplay in response to a negative outcome from a challenge. A challenge can be any insurance enabled gameplay event dependent upon player action, including a gameplay event implemented within the entertainment game (such as but not limited to a particular mountain to scale or a boss character to overcome in an adventure themed entertainment game) or the gambling game (such as but not limited to a particular wager of real world credits). The negative outcome (such as but not limited to failing to scale a particular mountain, overcome a boss character or losing an amount of RWC in a wager) can be utilized to trigger a particular insurance safeguard.

In numerous embodiments, an insurance safeguard can be applied that alters an insurance enabled hybrid game by providing an insurance payout, rewinding gameplay, repeating gameplay or skipping gameplay. In various embodiments, an insurance safeguard can provide an insurance payout in response to a particular negative outcome from a challenge as a payout of gameplay resources to a player (such as but not limited to RWC, GWC and elements). In a number of embodiments, an insurance safeguard can rewind gameplay by providing a player with another opportunity to overcome a challenge, such as but not limited to by rewinding entertainment game gameplay progression to a point prior to the outcome of the challenge by recording game state data that can be utilized to recreate an entertainment game at a point prior to the outcome of the challenge and restarting the entertainment game configured with the game state data to recreate entertainment game gameplay at the point prior to the outcome of the challenge. In certain embodiments, a player can be forced to repeat an attempt to overcome a challenge after an insurance safeguard rewinds gameplay. In a number of embodiments, an insurance safeguard can skip gameplay by advancing a player in the entertainment game to a point beyond the challenge by storing game state data that can be utilized to execute an entertainment game at a point past the outcome of the challenge and restarting the entertainment game configured with the game state data to recreate entertainment game gameplay at the point past the challenge.

In several embodiments, an insurance database can be utilized to store information that enables an insurance module to function, such as but not limited to insurance activation rules, information identifying insurance trigger events, insurance relationships, information identifying challenges and negative outcomes, insurance fees and insurance safeguards. Information in an insurance database can be loaded from a remote server accessible to the insurance module over a network or stored locally on an insurance enabled hybrid game. In certain embodiments, a server maintains an insurance database accessible to multiple insurance enabled hybrid games over a network. In other embodiments, each insurance enabled hybrid game maintains an insurance database locally that is accessible by the insurance module or other remote insurance modules over a network.

In numerous embodiments, an insurance module can be implemented locally on an insurance enabled hybrid game within the GWE or ESE, remotely on an insurance enabled server accessible to an insurance enabled hybrid game via a network, or as a distributed system where processes of an insurance module occur locally on an insurance enabled hybrid game and on a remote server.

Insurance enabled hybrid games in accordance with embodiments of the invention are discussed below.

Insurance Enabled Hybrid Games

In many embodiments, an insurance enabled hybrid game integrates high levels of entertainment content with a game of skill (entertainment game), a gambling experience with a game of chance (gambling game). An insurance enabled hybrid game provides for random outcomes independent of player skill while providing that the user's gaming experience (as measured by obstacles/challenges encountered, time of play and other factors) is shaped by the player's skill. The insurance enabled hybrid game can also utilize an insurance module to implement an insurance safeguard that mitigates a negative outcome from a challenge presented during insurance enabled hybrid game gameplay. An insurance enabled hybrid game in accordance with an embodiment of the invention is illustrated in FIG. 1. The insurance enabled hybrid game 128 includes a RWE 102, GWE 112, ESE 120, gambling game user interface 122 and entertainment game user interface 124. The two user interfaces may be part of the same user interface but are separate in the illustrated embodiment. The RWE 102 is connected with the GWE 112 and the gambling game user interface 122. The ESE 120 is connected with the GWE 112 and the entertainment game user interface 124. The GWE 112 is connected also with the entertainment game user interface 124.

In several embodiments, the RWE 102 is the operating system for the gambling game of the insurance enabled hybrid game 128 and controls and operates the gambling game. The operation of a gambling game is enabled by RWC, such as money or other real world funds. A gambling game can increase or decreases an amount of RWC based on random gambling outcomes, where the gambling proposition of a gambling game is typically regulated by gaming control bodies. In many embodiments, the RWE 102 includes a RW operating system (OS) 104, random number generator (RNG) 106, level n real-world credit pay tables (Table Ln-RWC) 108, RWC meters 110 and other software constructs that enable a game of chance to offer a fair and transparent gambling proposition, and to contain the auditable systems and functions that can enable the game to obtain gaming regulatory body approval.

A random number generator (RNG) 106 includes software and/or hardware algorithms and/or processes, which are used to generate random outcomes. A level n real-world credit pay table (Table Ln-RWC) 108 is a table that can be used in conjunction with a random number generator (RNG) 106 to dictate the real world credits (RWC) earned as a function of sponsored gameplay and is analogous to the pay tables used in a conventional slot machine. Table Ln-RWC payouts are independent of player skill. There may be one or a plurality of Table Ln-RWC pay tables 108 contained in a gambling game, the selection of which may be determined by factors including (but not limited to) game progress a player has earned, and/or bonus rounds which a player may be eligible for. Real world credits (RWC) are credits analogous to slot machine game credits, which are entered into a gambling game by the user, either in the form of money such as hard currency or electronic funds. RWCs can be decremented or augmented based on the outcome of a random number generator according to the Table Ln-RWC real world credits pay table 108, independent of player skill. In certain embodiments, an amount of RWC can be used as criteria in order to enter higher ESE 120 game levels. RWC can be carried forward to higher game levels or paid out if a cash out is opted for by a player. The amount of RWC used to enter a specific level of the game level n need not be the same for each level.

In many embodiments, the GWE 112 manages the overall insurance enabled hybrid game operation, with the RWE 102 and the ESE 120 effectively being support units to the GWE 112. In several embodiments, the GWE 112 contains mechanical, electronic and software system for an entertainment game. The GWE 112 includes an operating system (OS) 114 that provides control of the entertainment game. The GWE additionally contains a level n game world credit pay table (Table Ln-GWC) 116 from where to take input from this table to affect the play of the entertainment game. The GWE 112 can further couple to the RWE 102 to determine the amount of RWC available on the game and other metrics of wagering on the gambling game (and potentially affect the amount of RWC in play on the RWE 102). The GWE additionally contains various audit logs and activity meters (such as the GWC meter) 118. The GWE 112 can also couple to a centralized server for exchanging various data related to the player and their activities on the game. In many embodiments, the GWE includes an insurance module 130 that manages the proposal and application of insurance propositions that are presented to a player of an insurance enabled hybrid game. The GWE 112 furthermore couples to the ESE 120.

In many embodiments, a level n game world credit pay table (Table Ln-GWC) 116 dictates the GWC earned as a function of player skill in the nth level of the game. The payouts governed by this table are dependent upon player skill and sponsored gameplay at large and may or may not be coupled to a random number generator. In several embodiments, game world credits (GWC) are player points earned or depleted as a function of player skill, specifically as a function of player performance in the context of the game. GWC is analogous to the score in a typical video game. Each entertainment game has one or more scoring criterion, embedded within the Table Ln-GWC 116 that reflects player performance against the goal(s) of the game. GWC can be carried forward from one level of sponsored gameplay to another, and ultimately paid out in various manners such as directly in cash, or indirectly such as earning entrance into a sweepstakes drawing, or earning participation in, or victory in, a tournament with prizes. GWC may be stored on a player tracking card or in a network-based player tracking system, where the GWC is attributed to a specific player.

In certain embodiments, the operation of the GWE 112 does not affect the RWE's 102 gambling operation except for player choice parameters that are allowable in slot machines including but not limited to wager terms such as but not limited to a wager amount, how fast the player wants to play (by pressing a button or pulling the slot's handle) and/or agreement to wager into a bonus round. In this sense, the RWE 102 provides a fair and transparent, non-skill based gambling proposition co-processor to the GWE 112. In the illustrated embodiment, the communication link shown between the GWE 112 and the RWE 102 allows the GWE 112 to obtain information from the RWE 102 as to the amount of RWC available in the gambling game. The communication link can also convey a status operation of the RWE 102 (such as on-line or tilt). The communication link can further communicate the various gambling control factors which the RWE 102 uses as input, such as the number of RWC consumed per game or the player's election to enter a jackpot round. In FIG. 1, the GWE 112 is also shown as connecting to the player's user interface directly, as this may be utilized to communicate certain entertainment game club points, player status, control the selection of choices and messages which a player may find useful in order to adjust the entertainment game experience or understand their gambling status in the RWE 102.

In various embodiments, the ESE 120 manages and controls the visual, audio, and player control for the entertainment game. In certain embodiments, the ESE 120 accepts input from a player through a set of hand controls, and/or head, gesture, and/or eye tracking systems and outputs video, audio and/or other sensory output to a user interface. In many embodiments, the ESE 120 can exchange data with and accept control information from the GWE 112. In several embodiments an ESE 120 can be implemented using a personal computer (PC), a Sony PlayStation® (a video game console developed by Sony Computer Entertainment of Tokyo Japan), or Microsoft Xbox® (a video game console developed by Microsoft Corporation of Redmond, Washington) running a specific entertainment game software program. In numerous embodiments, an ESE can be an electromechanical game system of an insurance enabled hybrid game that is an electromechanical hybrid game. An electromechanical hybrid game executes an electromechanical game for player entertainment. The electromechanical game can be any game that utilizes both mechanical and electrical components, where the game operates as a combination of mechanical motions performed by at least one player or the electromechanical game itself. Various electromechanical hybrid games are discussed in Patent Cooperation Treaty Application No. PCT/US12/58156, filed Sep. 29, 2012, the contents of which are hereby incorporated by reference in their entirety.

The ESE 120 operates mostly independently from the GWE 112, except that via the interface, the GWE 112 may send certain entertainment game control parameters and elements to the ESE 120 to affect its play, such as (but not limited to) what level of character to be using, changing the difficulty level of the game, changing the type of gun or car in use, and/or requesting potions to become available or to be found by the character. These game control parameters and elements may be based on a gambling outcome of a gambling game that was triggered by an element in the entertainment game being acted upon by the player. The ESE 120 can accept this input from the GWE 112, make adjustments, and continue the play action all the while running seamlessly from the player's perspective. The ESE's operation is mostly skill based, except for where the ESE's processes may inject complexities into the game by chance in its normal operation to create unpredictability in the entertainment game. Utilizing this interface, the ESE 120 may also communicate player choices made in the game to the GWE 112, such as but not limited to selection of a different gun, and/or the player picking up a special potion in the GW environment. The GWE's job in this architecture, being interfaced thusly to the ESE 120, is to allow the transparent coupling of entertainment software to a fair and transparent random chance gambling game, providing a seamless perspective to the player that they are playing a typical popular entertainment game (which is skill based). In certain embodiments, the ESE 120 can be used to enable a wide range of entertainment games including but not limited to popular titles from arcade and home video games, such as but not limited to Gears of War® (a third person shooter game developed by Epic Games of Cary, N.C.), Time Crisis® (a shooter arcade game developed by Namco Ltd of Tokyo, Japan), or Madden Football® (an American football video game developed by EA Tiburon of Maitland, Fla.). Providers of such software can provide the previously described interface by which the GWE 112 can request amendments to the operation of the ESE 120 software in order to provide seamless and sensible operation as both a gambling game and an entertainment game.

In several embodiments, the RWE 102 can accept a trigger to run a gambling game in response to actions taken by the player in the entertainment game as conveyed by the ESE 120 to the GWE 112, or as triggered by the GWE 112 based on its algorithms, background to the overall game from the player's perspective, but can provide information to the GWE 112 to expose the player to certain aspects of the gambling game, such as (but not limited to) odds, amount of RWC in play, and amount of RWC available. The RWE 102 can accept modifications in the amount of RWC wagered on each individual gambling try, or the number of games per minute the RWE 102 can execute, entrance into a bonus round, and other factors, all the while these factors can take a different form than that of a typical slot machine. An example of a varying wager amount that the player can choose might be that they have decided to play with a more powerful character in the game, a more powerful gun, or a better car. These choices can increase or decrease the amount wagered per individual gambling game, in the same manner that a standard slot machine player may decide to wager more or less credits for each pull of the handle. In several embodiments, the RWE 102 can communicate a number of factors back and forth to the GWE 112, via an interface, such increase/decrease in wager being a function of the player's decision making as to their operational profile in the entertainment game (such as but not limited to the power of the character, gun selection or car choice). In this manner, the player is always in control of the per game wager amount, with the choice mapping to some parameter or component that is applicable to the entertainment game experience of the hybrid game. In a particular embodiment, the RWE 102 operation can be a game of chance as a gambling game running every 10 seconds where the amount wagered is communicated from the GWE 112 as a function of choices the player makes in the operation profile in the entertainment game such as those cited above.

In many embodiments, an insurance enabled hybrid game integrates a video game style gambling machine, where the gambling game (including an RWE 102 and RWC) is not player skill based, while at the same time allows players to use their skills to earn club points which a casino operator can translate to rewards, tournament opportunities and prizes for the players. The actual exchange of monetary funds earned or lost directly from gambling against a game of chance in a gambling game, such as a slot machine, is preserved. At the same time a rich environment of rewards to stimulate gamers can be established with the entertainment game. In several embodiments, the insurance enabled hybrid game can leverage very popular titles with gamers and provides a sea change environment for casinos to attract players with games that are more akin to the type of entertainment that a younger generation desires. In various embodiments, players can use their skill towards building and banking GWC that in turn can be used to win tournaments and various prizes as a function of their gamer prowess. Numerous embodiments minimize the underlying changes needed to the aforementioned entertainment software for the hybrid game to operate within an entertainment game construct, thus making a plethora of complex game titles and environments, rapid and inexpensive to deploy in a gambling environment.

In certain embodiments, insurance enabled hybrid games also allow players to gain entry into subsequent competitions through the accumulation of game world credits (GWC) as a function of the user's demonstrated skill at the game. These competitions can pit individual players or groups of players against one another and/or against the casino to win prizes based upon a combination of chance and skill. These competitions may be either asynchronous events, whereby players participate at a time and/or place of their choosing, or they may be synchronized events, whereby players participate at a specific time and/or venue.

In many embodiments, one or more players engage in playing an entertainment game, resident in the ESE 120, the outcomes of which are dependent at least in part on skill. The insurance enabled hybrid game can include an entertainment game that includes head to head play between a single player and the computer, between two or more players against one another, or multiple players playing against the computer and/or each other, as well as the process by which players bet on the outcome of the entertainment game. The entertainment game can also be a game where the player is not playing against the computer or any other player, such as in games where the player is effectively playing against himself or herself (such as but not limited to Solitaire and Babette).

Figure 2:
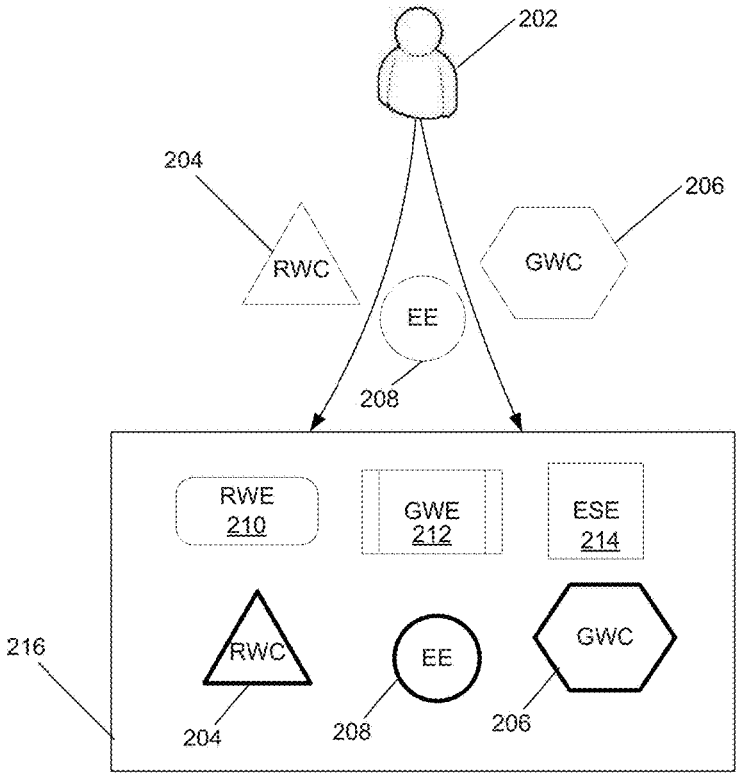
FIG. 2 is a conceptual diagram that illustrates how resources are utilized in an insurance enabled hybrid game in accordance with an embodiment of the invention.

In several embodiments, a player can interact with an insurance enabled hybrid game by using RWC in interactions with a gambling game along with GWC and elements in interactions with an entertainment game. The gambling game can be executed by a RWE while an entertainment game can be executed with an ESE and managed with a GWE. A conceptual diagram that illustrates how resources such as GWC, RWC and elements, such as but not limited to EE, are utilized in an insurance enabled hybrid game in accordance with an embodiment of the invention is illustrated in FIG. 2. The conceptual diagram illustrates that RWC 204, EE 208 and GWC 206 can be utilized by a player 202 in interactions with the RWE 210, GWE 212 and ESE 214 of an insurance enabled hybrid game 216. The contribution of elements, such as EE 208, may be linked to a player's access to credits, such as RWC 204 or GWC 206. Electronic receipt of these credits may come via a smart card, voucher, or other portable media, or as received over a network from a server. In certain implementations, these credits may be drawn on demand from a player profile located in a database locally on an insurance enabled hybrid game or in a remote server.

Figure 3:
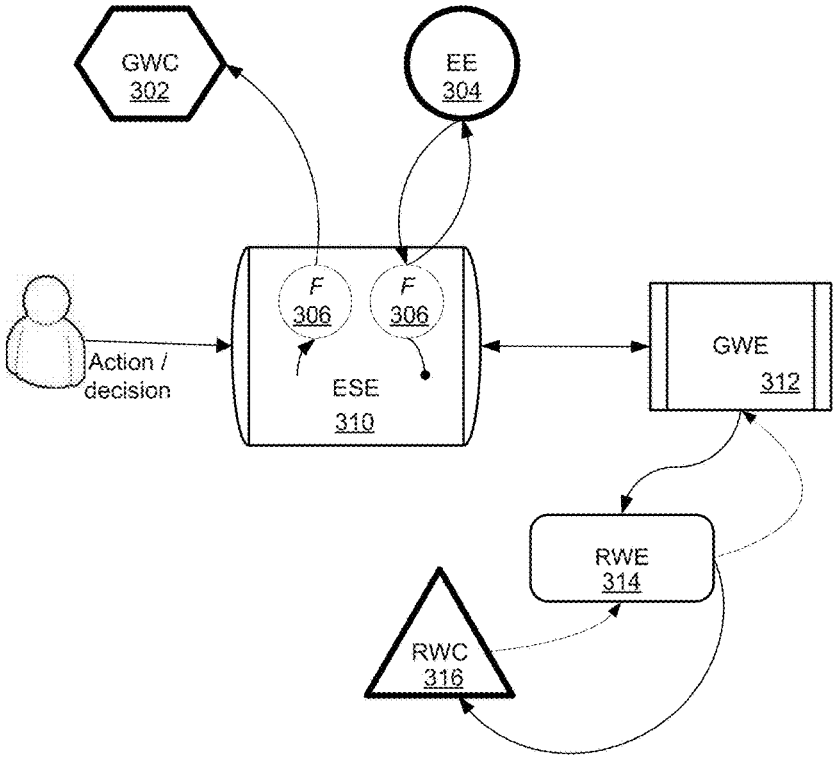
FIG. 3 is a conceptual diagram that illustrates interplay between resources and components of an insurance enabled hybrid game in accordance with an embodiment of the invention.

A conceptual diagram that illustrates interplay between elements and components of an insurance enabled hybrid game in accordance with an embodiment of the invention is illustrated in FIG. 3. Similar to FIG. 2, a player's actions and/or decisions can affect functions 306 that consume and/or accumulate GWC 302 and/or EE 304 in an entertainment game executed by an ESE 310. A GWE 312 can monitor the activities taking place within an entertainment game executed by an ESE 310 for gameplay gambling event occurrences. The GWE 312 can also communicate the gameplay gambling event occurrences to an RWE 314 that triggers a wager of RWC 316 in a gambling game executed by the RWE 314.

Figure 4:
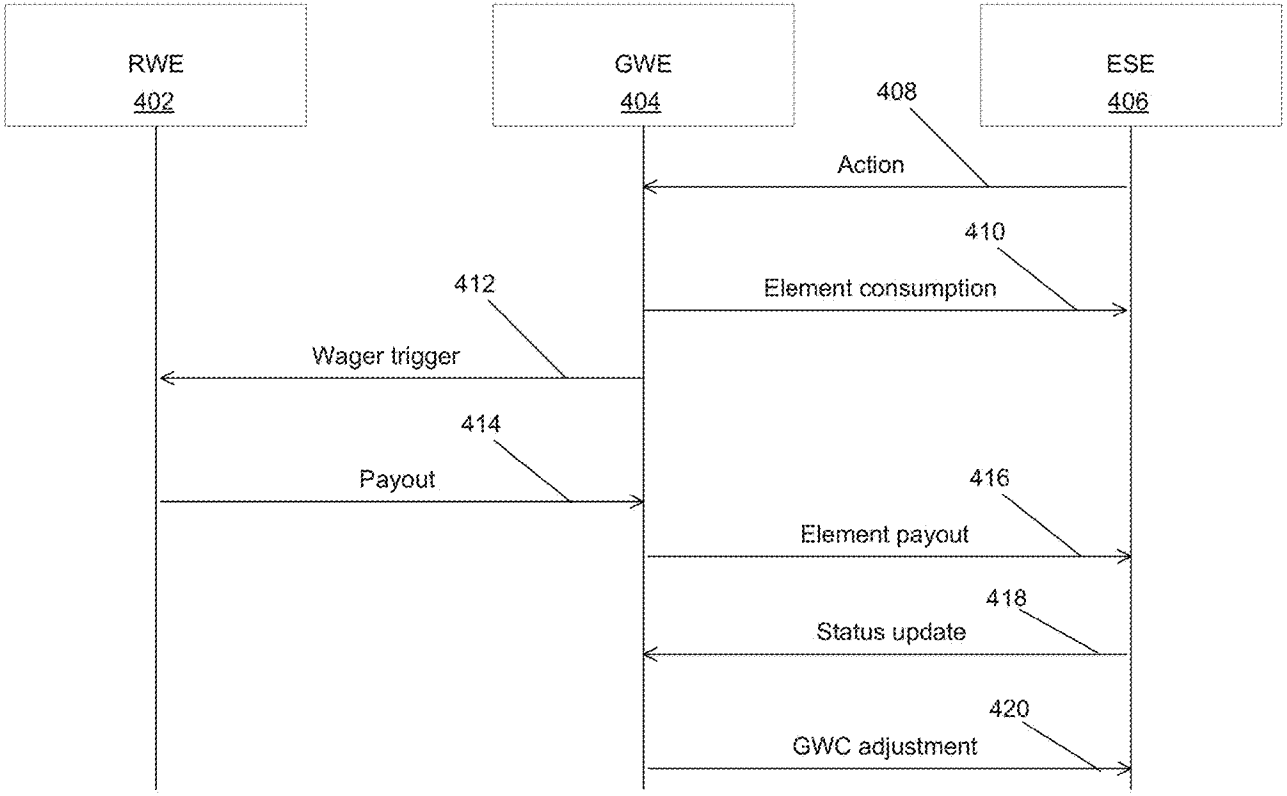
FIG. 4 is a timing diagram that illustrates a process of facilitating interactions between an entertainment game and a gambling game in accordance with embodiments of the invention.

A timing diagram that illustrates a process of facilitating interactions between an entertainment game and a gambling game in accordance with embodiments of the invention is illustrated in FIG. 4. The process includes a player performing a player action using a user interface. An ESE 406 can signal (408) a GWE 404 of the player action. The GWE 404 can signal (410) the ESE 406 as to the amount of EE that will be consumed by the player action in return. The signal can configure a function that controls EE consumption, decay or addition for the ESE 406. The ESE 406 can, based upon the function, consume an amount of EE designated by the GWE 404 to couple to the activity. Upon detection that the player action is a gameplay gambling event, the GWE 404 can signal an RWE 402 as to the wager terms associated with the gameplay gambling event triggers (412) a wager. The RWE 402 can consume RWC in executing the wager. The RWE 402 can return RWC as a payout from the wager. The RWE 402 can inform (414) the GWE 404 as to the payout from the wager. The GWE 404 can signal (416) the ESE 406 to ascribe a payout of EE based upon the wager. The ESE 406 can reconcile and combine the payout of EE with the EE already ascribed to the player in the entertainment game. The ESE 406 can signal (408) the GWE 404 as to its updated status based upon reconciling the payout of EE, and the GWE 404 can signal the ESE 406 of a payout of GWC in response (420) to the status update.

In certain embodiments, the sequence of events in the timing diagram of FIG. 4 can be reflected in a first person shooter themed entertainment game. For example, a player can select a machine gun to use in an entertainment game and fires a burst at an opponent. The ESE 406 can signal (408) the GWE 404 of the player action, such as the player's choice of weapon, that a burst of fire was fired, and the outcome of whether the player hit the opponent with the burst of fire. The GWE 404 can process the information concerning the machine gun burst, and signal (410) the ESE to consume 3 bullets (EE) with each pull of the trigger. The entertainment game then will consume 3 bullets (EE) based upon the trigger being pulled. The GWE 404 can also signal (412) the RWE 402 that 3 credits of RWC are to be wagered to match the 3 bullets (EE) consumed, on a particular pay table (Table Ln-RC) as a function how much damage the player inflicted on his/her opponent. The RWE 402 can consume the 3 credits for the wager and execute the specified wager. In executing the wager, the RWE 402 can determine that the player hits a jackpot of 6 credits, and return the 6 credits of RWC to the credit meter. The RWE 402 can also inform (414) the GWE 404 that 3 credits of RWC net were won as a payout from the wager. The GWE 404 can signal (416) the ESE 406 to add 3 bullets (EE) to the player's ammunition clip based upon the gambling game payout. The ESE 406 can then add 3 bullets (EE) to the player's ammunition clip in the entertainment game. This may take place by directly adding them to the clip, or may happen in the context of the entertainment game, such as the player finding extra ammunition on the ground or in an old abandoned ammunition dump. The GWE 404 can receive (418) an update from the ESE 406 as to the total amount of EE associated with the player. The GWE 404 can log the new player score (GWC) in the game (as a function of the successful hit on the opponent) based on the update, and signal (420) the ESE 406 to add 2 extra points of GWC to the player's score.

In many embodiments, if an entertainment game employs an American football themed game, a player can bet on whether or not the player is going to beat the computer, or in the case the player is playing against another player, that other player. These bets can be made, for example, on the final outcome of the game, and/or the state of the game along various intermediary points (such as but not limited to the score at the end of the 1st quarter) and/or on various measures associated with the game (such as but not limited to the total offensive yards, number of turnovers, or number of sacks). Players can bet against one another, or engage the computer in a head to head competition in the context of their skill level in the entertainment game in question. As such, players can have a handicap associated with their player profile that describes their skill (which can be their professed skill in certain embodiments), and which is used by a GWE (such as a local GWE or a GWE that receives services from remote servers) to offer appropriate bets around the final and/or intermediate outcomes of the entertainment game, and/or to condition sponsored gameplay as a function of player skill, and/or to select players across one or more insurance enabled hybrid games to participate in head to head games and/or tournaments.

Many embodiments enable the maximization of the number of players able to compete competitively by enabling handicapping of players by utilizing a skill normalization module that handicaps players to even the skill level of players competing against each other. Handicapping enables players of varying performance potential to compete competitively regardless of absolute skill level, such as but not limited to where a player whose skill level identifies the player as a beginner can compete in head to head or tournament play against a highly skilled player with meaningful results.

In several embodiments, wagers can be made among numerous insurance enabled hybrid games with a global betting manager (GBM). The GBM is a system that coordinates wagers that are made across multiple insurance enabled hybrid games by multiple players. In some implementations it can also support wagers by third parties relative to the in game performance of other players. The GBM can stand alone, or is capable of being embedded in one of a number of systems, including a GWE, ESE or any remote server capable of providing services to an insurance enabled hybrid game, or can operate independently on one or a number of servers on-site at a casino, as part of a larger network and/or the Internet or cloud in general. The GBM also supports the management of lottery tickets issued as a function of sponsored gameplay.

Although various components of insurance enabled hybrid games are discussed above, insurance enabled hybrid games can be configured with any component as appropriate to the requirements of a specific application in accordance with embodiments of the invention. In certain embodiments, components of an insurance enabled hybrid game, such as a GWE, RWE, ESE can be networked in different configurations for a specific insurance enabled hybrid game gameplay application. Network connected insurance enabled hybrid games are discussed below.

Network Connected Insurance Enabled Hybrid Games

Insurance enabled hybrid games in accordance with many embodiments of the invention can operate locally while being network connected to draw services from remote locations or to communicate with other insurance enabled hybrid games. In many embodiments, operations associated with an insurance enabled hybrid game utilizing an insurance module can be performed across multiple devices. These multiple devices can be implemented using a single server or a plurality of servers such that an insurance enabled hybrid game is executed as a system in a virtualized space, such as (but not limited to) where the RWE and GWE are large scale centralized servers in the cloud coupled to a plurality of widely distributed ESE controllers or clients via the internet.

In many embodiments, an RWE server can perform certain functionalities of a RWE of an insurance enabled hybrid game. In certain embodiments, a RWE server includes a centralized odds engine which can generate random outcomes (such as but not limited to win/loss outcomes) for a gambling game, thereby eliminating the need to have that functionality of the RWE performed locally within the insurance enabled hybrid game. The RWE server can perform a number of simultaneous or pseudo-simultaneous runs in order to generate random outcomes for a variety of odds percentages that one or more networked insurance enabled hybrid games may require. In certain embodiments, an RWE of an insurance enabled hybrid game can send information to a RWE server including (but not limited to) Table Ln-RWC tables, maximum speed of play for a gambling game, gambling game monetary denominations or any promotional RWC provided by the operator of the insurance enabled hybrid game. In particular embodiments, a RWE server can send information to a RWE of an insurance enabled hybrid game including (but not limited to)

RWC used in the gambling game, player profile information or play activity and a profile associated with a player.

In several embodiments, a GWE server can perform the functionality of the GWE across various insurance enabled hybrid games. These functionalities can include (but are not limited to) providing a method for monitoring high scores on select groups of games, coordinating interactions between gameplay layers, linking groups of games in order to join them in head to head tournaments, and acting as a tournament manager.

In a variety of embodiments, management of player profile information can be performed by a patron management server separate from a GWE server. A patron management server can manage information related to a player profile, including (but not limited to) data concerning controlled entities (such as characters used by a player in entertainment game gameplay), game scores, elements, RWC and GWC associated with particular players and managing tournament reservations. Although a patron management server is discussed separate from a GWE server, in certain embodiments a GWE server also performs the functions of a patron management server. In certain embodiments, a GWE of an insurance enabled hybrid game can send information to a patron management server including (but not limited to) GWC and RWC used in a game, player profile information, play activity and profile information for players and synchronization information between a gambling game and an entertainment game or other aspects of an insurance enabled hybrid game. In particular embodiments, a patron management server can send information to a GWE of an insurance enabled hybrid game including (but not limited to) entertainment game title and type, tournament information, Table Ln-GWC tables, special offers, character or profile setup and synchronization information between a gambling game and an entertainment game or other aspects of an insurance enabled hybrid game.

In numerous embodiments, an ESE server provides a host for managing head to head play, operating on the network of ESEs which are connected to the ESE server by providing an environment where players can compete directly with one another and interact with other players. Although an ESE server is discussed separate from a GWE server, in certain embodiments a GWE server also performs the functions of an ESE server.

In several embodiments, an insurance enabled server can be connected with an insurance enabled hybrid game and can implement an insurance module to coordinate the activities of an insurance enabled hybrid game. An insurance module can execute as part of an insurance enabled server to implement an insurance safeguard that mitigates a negative outcome from a challenge presented during insurance enabled hybrid game gameplay.

Servers connected via a network to implement insurance enabled hybrid games in accordance with many embodiments of the invention can communicate with each other to provide services utilized within an insurance enabled hybrid game. In several embodiments a RWE server can communicate with a GWE server. A RWE server can communicate with a GWE server to communicate any type of information as appropriate for a specific application, including (but not limited to): configure the various simultaneous or pseudo simultaneous odds engines executing in parallel within the RWE to accomplish the insurance enabled hybrid game system requirements, determine metrics of RWE performance such as random executions run and outcomes for tracking system performance, perform audits, provide operator reports, and request the results of a random run win/loss result for use of function operating within the GWE (such as where automatic drawings for prizes are a function of ESE performance).

In several embodiments a GWE server can communicate with an ESE server. A GWE server can communicate with an ESE server to communicate any type of information as appropriate for a specific application, including (but not limited to): the management of an ESE server by a GWE server such as the management of an insurance enabled hybrid game tournament. Typically a GWE (such as a GWE that runs within an insurance enabled hybrid game or on a GWE server) is not aware of the relationship of itself to the rest of a tournament since in a typical configuration the actual tournament play is managed by the ESE server. Therefore, management of an insurance enabled hybrid game tournament can include (but is not limited to) tasks such as: conducting tournaments according to system programming that can be coordinated by an operator of the insurance enabled hybrid game; allowing entry of a particular player into a tournament; communicating the number of players in a tournament and the status of the tournament (such as but not limited to the amount of surviving players, their status within the game, time remaining on the tournament); communicating the status of an ESE contained in a game; communicating the performance of its players within the tournament; communicating the scores of the various members in the tournament; and providing a synchronizing link to connect the GWEs in a tournament, with their respective ESE's.

In several embodiments a GWE server can communicate with a patron management server. A GWE server can communicate with a patron server to communicate any type of information as appropriate for a specific application, including (but not limited to) information for configuring tournaments according to system programming conducted by an operator of an insurance enabled hybrid game, exchange of data used to link a player's player profile to their ability to participate in various forms of sponsored gameplay (such as but not limited to the difficulty of play set by the GWE server or the GWE in the game they are playing on), determining a player's ability to participate in a tournament as a function of a player's characteristics (such as but not limited to a player's gaming prowess or other metrics used for tournament screening), configuring the game contained GWE and ESE performance to suit preferences of a player on a particular insurance enabled hybrid game, as recorded in their player profile, determining a player's play and gambling performance for the purposes of marketing intelligence, and logging secondary drawing awards, tournament prizes, RWC and GWC into the player profile.

In many embodiments, the actual location of where various algorithms and functions are executed may be located either in the game contained devices (RWE, GWE, ESE), on the servers (RWE server, GWE server, or ESE server), or a combination of both. In particular embodiments, certain functions of a RWE server, GWE server, patron management server or ESE server may operate on the local RWE, GWE or ESE contained with an insurance enabled hybrid game locally. In certain embodiments, a server is a server system including a plurality of servers, where software may be run on one or more physical devices. Similarly, in particular embodiments, multiple servers may be combined on a single physical device.

Figure 5:
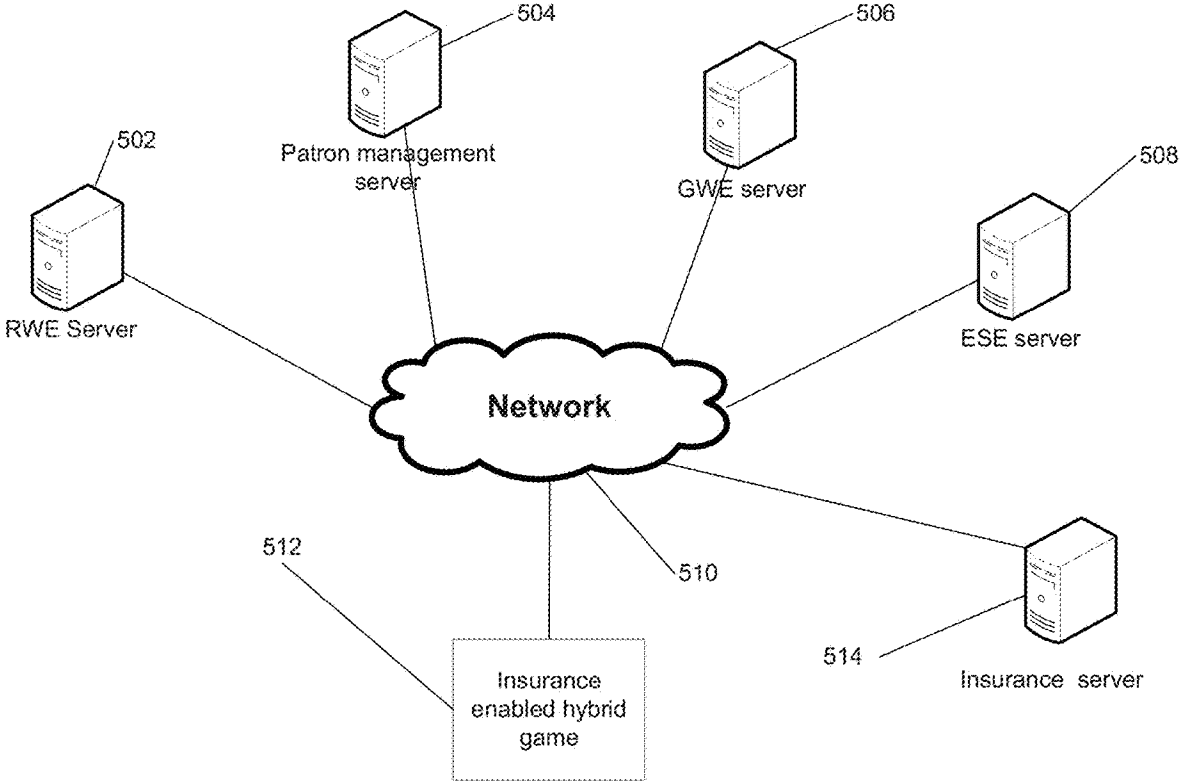
FIG. 5 is a system diagram that illustrates a network distributed insurance enabled hybrid game in accordance with an embodiment of the invention.

Insurance enabled hybrid games in accordance with many embodiments of the invention can be networked with remote servers in various configurations. A networked insurance enabled hybrid game in accordance with an embodiment of the invention is illustrated in FIG. 5. The networked insurance enabled hybrid game 512 is connected with a RWE server 502, patron management server 504, GWE server 506, ESE server 508 and an insurance enabled server 514 over a network 510, such as (but not limited to) the internet. Servers networked with a networked insurance enabled hybrid game 512 can also communicate with each of the components of a networked insurance enabled hybrid game and amongst the other servers in communication with the networked insurance enabled hybrid game 512.

Figure 6:
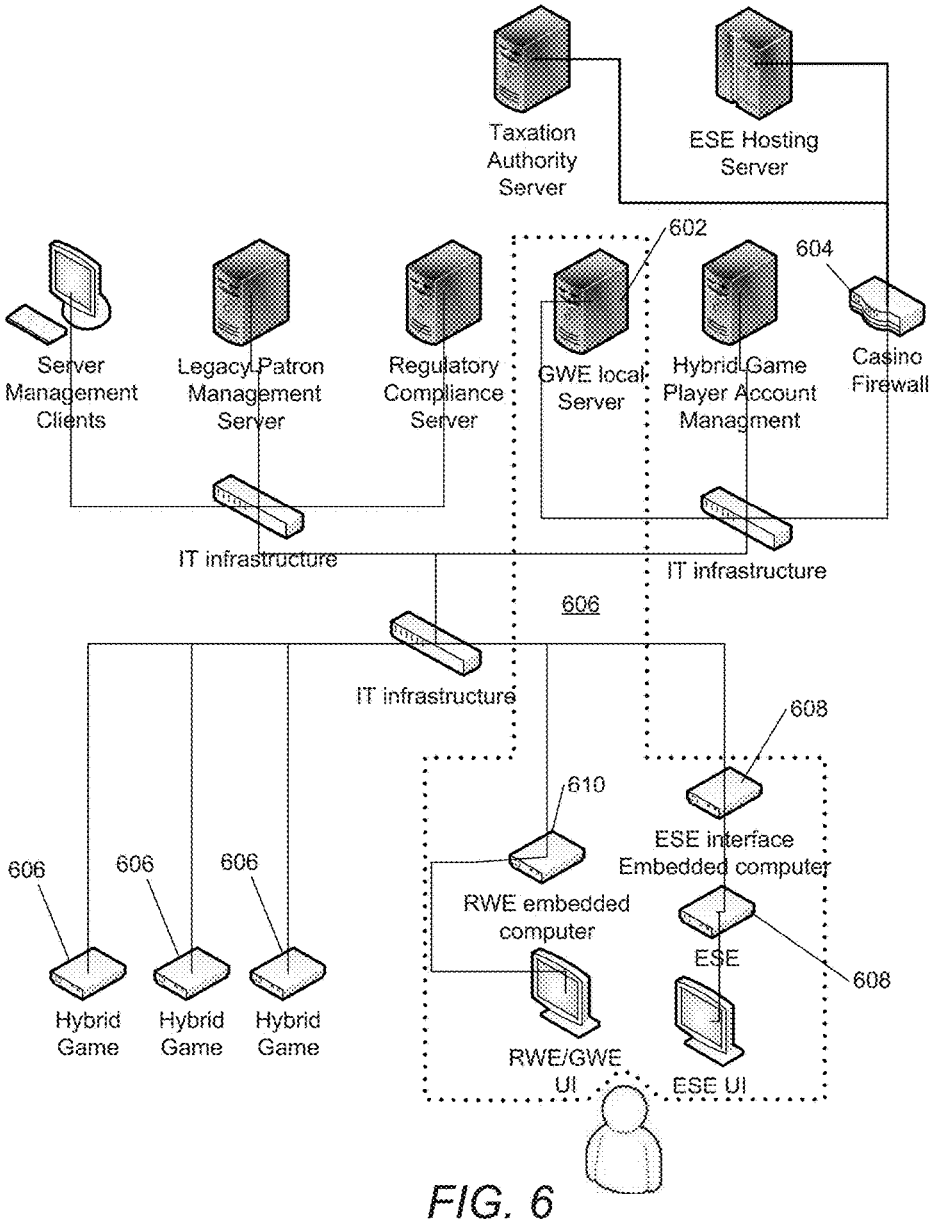
FIG. 6 is a system diagram that illustrates an implementation of a network distributed insurance enabled hybrid game including a game world engine local server in accordance with an embodiment of the invention.
Figure 7:
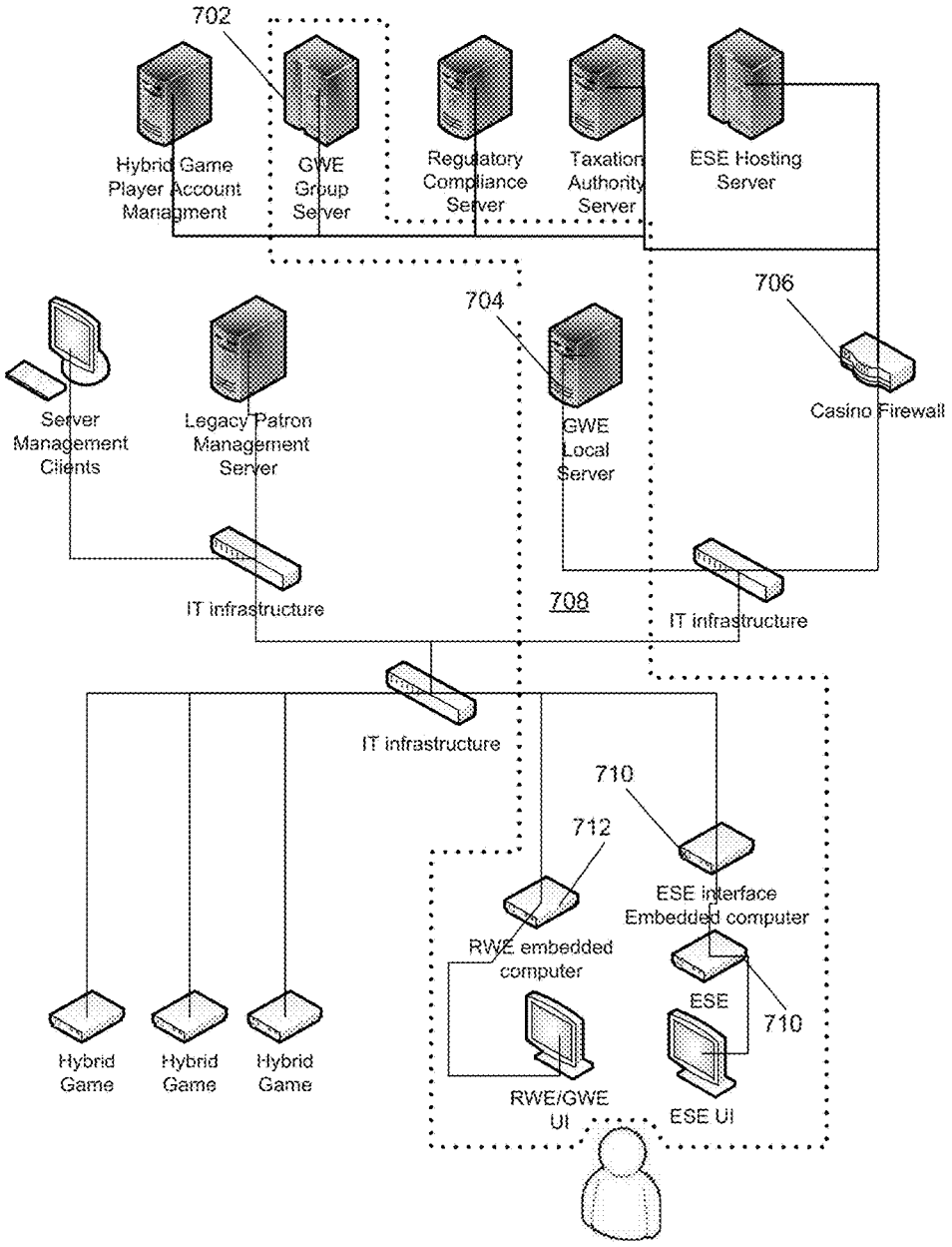
FIG. 7 is a system diagram that illustrates an implementation of a network distributed hybrid game including a game world engine group server in accordance with an embodiment of the invention.
Figure 8:
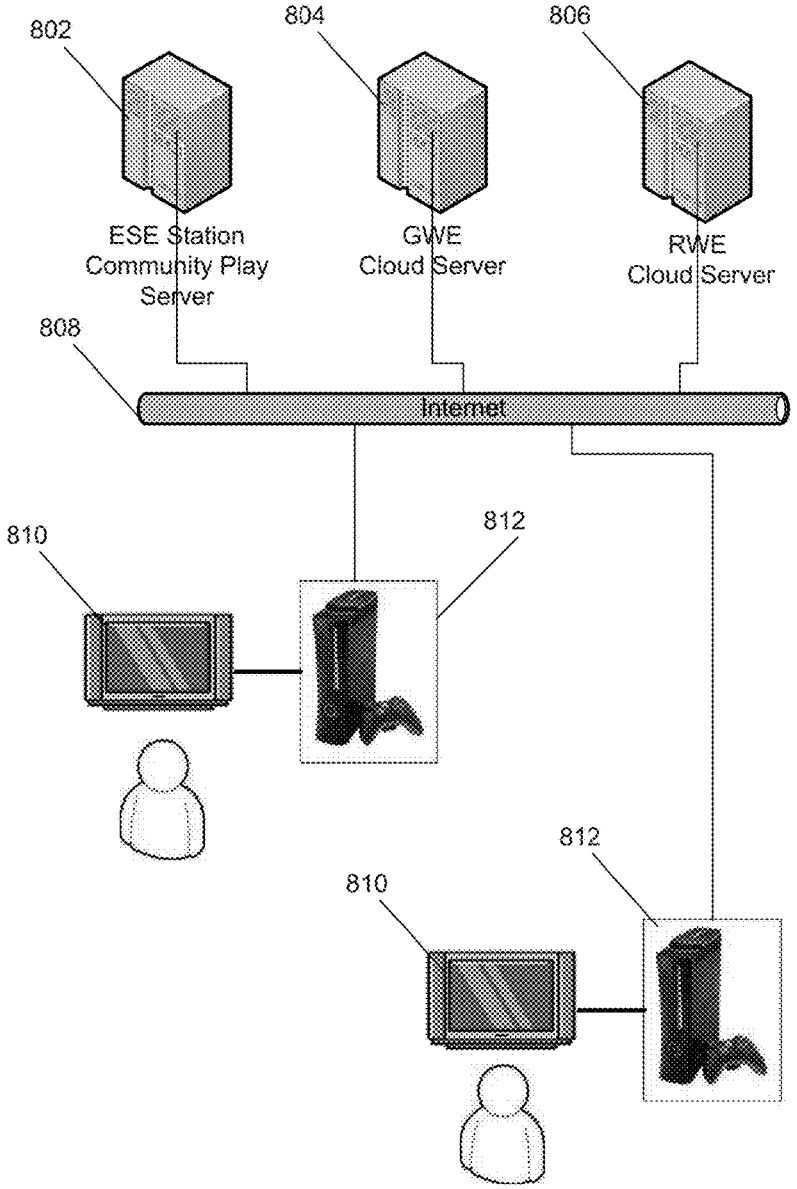
FIG. 8 is a system diagram that illustrates an implementation of an internet distributed hybrid game in accordance with an embodiment of the invention.

A system diagram that illustrates an implementation of a network distributed insurance enabled hybrid game with a GWE local server in accordance with an embodiment of the invention is illustrated in FIG. 6. The system includes several insurance enabled hybrid games 606 sharing services from the same GWE local server 602 over a network. A single insurance enabled hybrid game 606 with a RWE 610, ESE 608 and GWE 602 is enclosed within a dotted line. A number of other peripheral systems, such as player management, casino management, regulatory, and hosting servers can also interface with the insurance enabled hybrid games over a network within an operator's firewall 604. Also, other servers can reside outside the bounds of a network within an operator's firewall 604 to provide additional services for network connected insurance enabled hybrid games. A system diagram that illustrates an implementation of a network distributed hybrid game with a GWE local server and a GWE group server in accordance with an embodiment of the invention is illustrated in FIG. 7. This system includes an insurance enabled hybrid game with a RWE 712, ESE 710 and GWE 704 enclosed within a dotted line but where a single hybrid game can call upon services from servers within an operator's firewall 706 (such as but not limited to a GWE local server) as well as beyond an operator's firewall 706 (such but not limited to a GWE group server 702). The GWE group server 702 can coordinate multiple insurance enabled hybrid games from across a network that spans beyond an operator's firewall 706. A system diagram that illustrates an implementation of network distributed hybrid games over the Internet in accordance with an embodiment of the invention is illustrated in FIG. 8. The system includes an ESE server 802, GWE server 804 and RWE server 806 that connects to a user interface 810 of insurance enabled hybrid games over the internet 808. Each insurance enabled hybrid game includes a local ESE 812 that also interfaces with a remote ESE server 802.

Although various networked insurance enabled hybrid games are discussed above, insurance enabled hybrid games can be networked in any configuration as appropriate to the requirements of a specific application in accordance with embodiments of the invention. In certain embodiments, components of a networked insurance enabled hybrid game, such as a GWE, RWE, ESE or servers that perform services for a GWE, RWE or ESE, can be networked in different configurations for a specific networked insurance enabled hybrid game gameplay application. Insurance modules are discussed below.

Insurance Modules

An insurance module in accordance with many embodiments of the invention implements an insurance safeguard that mitigates a negative outcome from a challenge presented during insurance enabled hybrid game gameplay. A challenge is an insurance enabled hybrid game gameplay event dependent upon player action, which can provide different outcomes dependent upon player action related to the challenge. Certain player actions can yield unfavorable, negative outcomes relative to other outcomes resulting from different player actions. An insurance safeguard implemented by an insurance module can mitigate a negative outcome by altering insurance enabled hybrid game gameplay in response to the negative outcome in exchange for an insurance fee. In several embodiments, insurance safeguards can be presented as part of an insurance relationship between the insurance safeguard and an insurance fee and generated by an insurance proposition. Each insurance proposition can be associated with a particular insurance trigger event, such as but not limited to a challenge, with the insurance relationship from the insurance trigger event defined by an insurance activation rule.

In various embodiments, one or more insurance databases can be utilized to store information for ultimately applying an insurance safeguard to insurance enabled hybrid game gameplay. The information stored in an insurance database can include, but is not limited to, information concerning insurance safeguards, insurance relationships, insurance fees, insurance proposition rules, insurance propositions, insurance trigger events, challenges and/or insurance activation rules. An insurance database can be resident in any location accessible to an insurance module, including but not limited to within the GWE or ESE. In several embodiments, an insurance database can be maintained by an insurance module.

In a number of embodiments, an insurance module can be implemented in any manner accessible to an insurance enabled hybrid game, including but not limited to locally on an insurance enabled hybrid game within the GWE or ESE, on a remote server accessible to the insurance enabled hybrid game via a network or as a distributed system where processes of an insurance module occur locally on an insurance enabled hybrid game and on a remote server. In certain embodiments where processes of an insurance module are executed by a GWE, the insurance module can reference the information received at the GWE from the ESE against information stored in an insurance database to determine if an insurance trigger event has occurred that can activate an insurance proposition in accordance with an insurance activation rule. In particular embodiments, an insurance module distributed across a GWE and ESE can have certain processes performed on a ESE (such as but not limited to monitoring of the entertainment game using an ESE for an insurance trigger event) while other processes are performed on a GWE (such as but not limited to generation of an insurance relationship using a GWE upon receiving notification of the detection of the insurance trigger event by the ESE).

In many embodiments, an insurance module can monitor insurance enabled hybrid game gameplay for an insurance trigger event using an insurance activation rule. An insurance trigger event can be found from any combination of information generated during insurance enabled hybrid game gameplay as defined by an insurance activation rule such as but not limited to an entertainment game gameplay environment, overall status of an insurance enabled hybrid game, current status of a player, combinations of gameplay resources associated with a particular player or present at an insurance enabled gameplay session, preferences stored in a player's player profile, or a configuration of any aspect of an entertainment game that can change during gameplay. In certain embodiments, an insurance trigger event can be detected prior to the commencement of entertainment game gameplay, such as but not limited to while an entertainment game is being set up by a user or an operator of the insurance enabled hybrid game. In particular embodiments, an insurance trigger event can occur after a period of time has elapsed or upon progressing to a certain point in an entertainment game. In various embodiments, an insurance trigger event can include conditions related to a player's status, such as but not limited to whether a player is eligible to have an insurance safeguard applied during a period of the player's insurance enabled hybrid game gameplay session. In particular embodiments, information concerning head to head gameplay between players can be considered in defining an insurance trigger event. In several embodiments, insurance trigger events can be a status of insurance enabled hybrid game gameplay such as but not limited to when a player has a specific amount of RWC available, a CE has a certain amount of health points available in an adventure themed entertainment game, a CE has a certain dexterity in an adventure themed game when facing a challenge to pick a lock, possession of a particular race car CE in a racing themed entertainment game that has a certain average lap time on prior laps, a player has not invoked more than two insurance relationships during a current insurance enabled hybrid game gameplay session, a player has a minimum of amount of GWC, a player has a maximum of GWC, a player is ranked at a low or a high skill level, or a player enters head to head gameplay with a player at a higher skill level. In various embodiments, an insurance trigger event can be customized by an operator of an insurance enabled hybrid game, such as but not limited to defining an insurance trigger event or requiring operator approval as part of an insurance trigger event.

In several embodiments, an insurance trigger event can be utilized by an insurance proposition to generate at least one insurance relationship between an insurance safeguard and insurance fee that can be presented in a user interface of the insurance enabled hybrid game. In certain embodiments, the presentation in the user interface can cause an insurance enabled hybrid gameplay session to pause pending receipt of player approval via the user interface. In particular embodiments, various user interfaces can simultaneously present different information, such as but not limited to different insurance relationships for different players or the same players or different insurance enabled gameplay scenarios or information concerning an ongoing insurance enabled hybrid game. In a number of embodiments, the presentation of an insurance relationship for player acceptance via a user interface can occur as an insurance enabled hybrid game gameplay session progresses in parallel. In certain embodiments, an opportunity to accept an insurance relationship can be revoked after a particular amount of time has elapsed after presentation in a user interface or upon a change within insurance enabled hybrid game gameplay as dictated by the insurance proposition that generated the insurance relationship.

In various embodiments with an adventure themed entertainment game, a player's CE can enter battle with a character within the entertainment game, such as but not limited to a large ogre. An insurance module can monitor the insurance enabled hybrid game for when the CE is first made aware of the ogre's presence, as an insurance trigger event, in accordance with the insurance activation rule. The insurance proposition can generate at least one insurance relationship based upon the awareness of the ogre's presence and the insurance relationship can be presented in a user interface. The insurance relationship can be presented in the user interface in any fashion, such as but not limited to as a flashing icon along the bottom of a display screen with an accompanying chime sound. Also, an insurance relationship can be accepted by a player via the user interface in any fashion, such as but not limited to an affirmative selection of the insurance relationship using a cursor or touch on a touchscreen. Additionally, an insurance proposition can dictate a timeframe for acceptance of an insurance relationship, such as but not limited to a set period of time or prior to the occurrence of a particular gameplay event, such as the undertaking of a challenge.

In several embodiments, an insurance relationship can be implemented in accordance with an insurance proposition rule that dictates conditions in order for an insurance relationship to be applied to an insurance enabled hybrid game gameplay session. In several embodiments, an insurance proposition rule requires that an insurance relationship be accepted by a player before being implemented within the player's insurance enabled hybrid game gameplay. In certain embodiments, an insurance proposition rule does not require affirmative player acceptance in order to implement an insurance relationship in an insurance enabled hybrid game gameplay session, such as but not limited to when an insurance proposition rule relationship is applied automatically by the insurance module based upon a player or an operator's setting. In various embodiments, an insurance proposition rule can dictate the order at which aspects of an insurance relationship are applied, such as but not limited to collecting an insurance fee once an acceptance of the insurance relationship is detected by the insurance module and only applying an insurance safeguard in response to a negative outcome of a challenge after collection of the insurance fee. In several embodiments, the application of an insurance relationship can be reflected in a user interface to notify a player that an insurance relationship is applied and in play during an insurance enabled gameplay session.

In several embodiments, collection of an insurance fee can be any reallocation of resources, such as but not limited to a reallocation of gameplay resources away from a player profile during an insurance enabled game gameplay session. In certain embodiments, collection of an insurance fee can be performed by an insurance module and allocated from a player profile to a profile associated with an operator of an insurance enabled hybrid game. Gameplay resources collected as an insurance fee can be any resource that can be utilized in an insurance enabled hybrid game, such as but not limited to RWC, GWC, elements, items associated with a player, player club points or opportunities that a player can utilize to progress entertainment game gameplay.

In many embodiments, the insurance safeguard is applied in response to detection of a negative outcome of a challenge. In certain embodiments, an insurance module can also monitor the insurance enabled hybrid game gameplay for the negative outcome of the challenge as defined in an insurance relationship. An applied insurance safeguard can alter insurance enabled hybrid game gameplay to mitigate for a particular negative outcome of a challenge, such as but not limited to by providing a payout of gameplay resources to a player, providing a player another opportunity to overcome a challenge by rewinding entertainment game gameplay progression to a point prior to the outcome of the challenge or to skip a challenge by advancing a player in the entertainment game to a point beyond the challenge.

In several embodiments, a negative outcome of a challenge can be any outcome from a challenge including, but not limited to, a loss of elements, negative impact to a CE (such as but not limited to damage or loss of life, items or health points), or loss of GWC or RWC (such as from a loss of RWC in a wager or a low payout from a wager). An outcome that is a negative outcome of the challenge can also be a specific failure to overcome a challenge such as but not limited to, failing to complete a lap in a car race under a certain amount of time in a car race themed entertainment game, failing to open a door in an adventure themed entertainment game, failing to score a touchdown on a drive in a football themed entertainment game, running out of ammunition in a shooter themed entertainment game, being killed in battle during an adventure themed entertainment game, losing a challenge from another player to place a proper word on a board during a word guessing themed entertainment game, failing to roll a 4 or higher on a combat dice roll war themed entertainment game, or a player's civilization being swept into the sea by a tsunami in a civilization building themed entertainment game. In a number of embodiments, a negative outcome can be any kind of loss that occurs during insurance enabled hybrid game gameplay. A negative outcome can include but is not limited to a loss of an item, ability, advantage, character or any aspect of insurance enabled hybrid gameplay that can be purchased or earned during insurance enabled hybrid game gameplay.

In several embodiments, an insurance safeguard can be applied to insurance enabled hybrid game gameplay upon detection of a negative outcome from a challenge by rewinding gameplay to provide a player with an additional opportunity to overcome the challenge. The additional opportunity to overcome the challenge can be generated in various ways such as but not limited to rolling back the entertainment game gameplay progression to a point prior to the outcome of the challenge by recording game state data that can be utilized to recreate an entertainment game at a point prior to the outcome of the challenge. The insurance enabled hybrid game can then restart the entertainment game configured with the game state data to recreate entertainment game gameplay at the point prior to the outcome of the challenge. In certain embodiments, a player presented with the additional opportunity can forgo a particular challenge altogether and continue entertainment game gameplay without engaging the challenge. In particular embodiments, the player's state relative to that challenge in the additional opportunity can be a different but similar state to the player's state at the previous opportunity, such as but not limited to where the player is provided with different odds of success in overcoming the challenge or provided with an altered challenge.

In a number of embodiments, an insurance safeguard can be applied to insurance enabled hybrid game gameplay upon detection of a negative outcome by repeating gameplay to provide a player another opportunity to overcome a challenge that the player is forced to repeat. In certain embodiments, a player must continually face the challenge until the challenge is surmounted or the game terminates or other game factors intervene. These other game factors can include, but are not limited to, when another player surmounts the challenge in a multiplayer insurance enabled hybrid game or when another challenge takes priority in entertainment game gameplay.

In numerous embodiments, an insurance safeguard can be applied to insurance enabled hybrid game gameplay upon detection of a negative outcome by skipping gameplay to advance a player in the entertainment game to a point beyond the challenge. This can be accomplished by storing game state data that can be utilized to execute an entertainment game at a point past the outcome of the challenge. Then the entertainment game can be restarted and configured with the game state data to recreate entertainment game gameplay at the point past the challenge (such as but not limited to moving a player to a ledge beyond a deep canyon as though the player had successfully completed a challenge that was a jump across the canyon in an adventure themed entertainment game). In certain embodiments, a player can be placed in the same condition the player would be in should the player have surmounted the challenge. In other embodiments, a player can be placed in a different condition than the player would have been in if the player had surmounted the challenge (such as but not limited to where a player is advanced within the entertainment game gameplay but without receiving the GWC that the player would have received if the player had surmounted the challenge).

Figure 9:
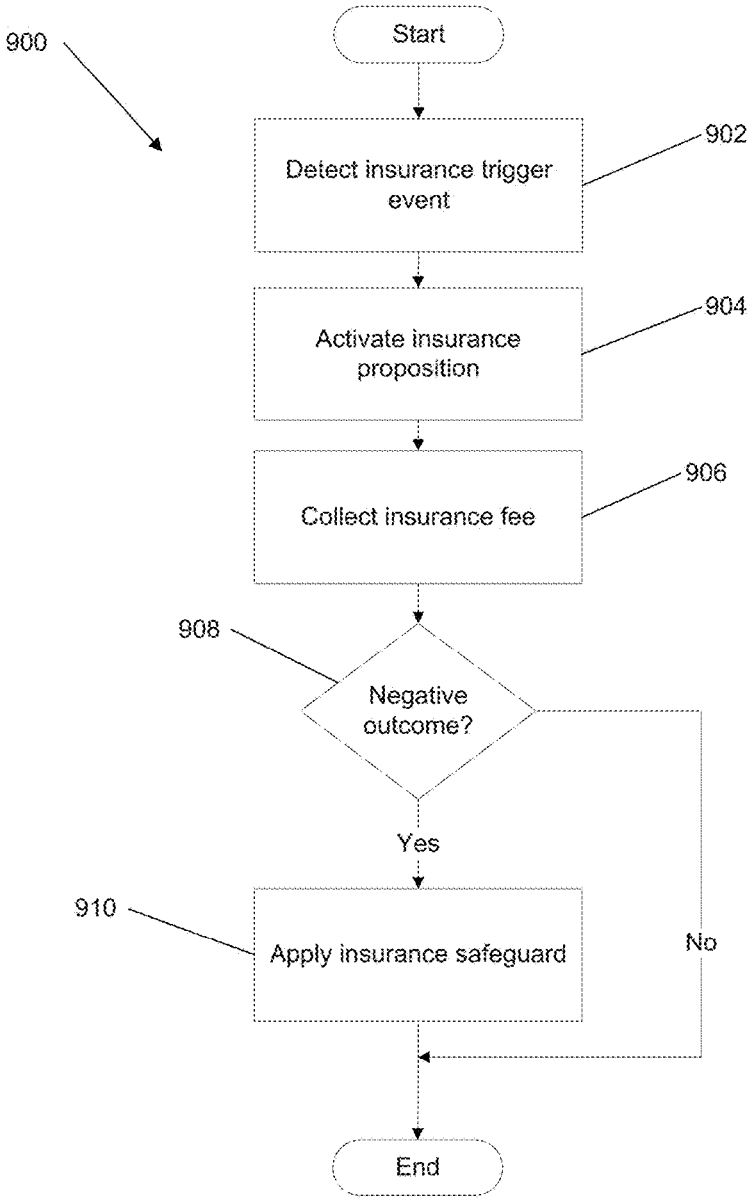
FIG. 9 illustrates a flow chart of a process for executing an insurance enabled hybrid game gameplay session in accordance with an embodiment of the invention.

A flow chart of a process of executing an insurance enabled hybrid game gameplay session in accordance with an embodiment of the invention is illustrated in FIG. 9. The process 900 includes detecting (902) an insurance trigger event. An insurance proposition can be activated (904) that generates at least one insurance relationship between an insurance fee collected from a player profile and an insurance safeguard whose application mitigates the effect of a negative outcome from a challenge during insurance enabled hybrid game gameplay. An insurance fee can be collected (906) and a decision can be made as to whether a negative outcome (908) from a challenge is detected. If a negative outcome is detected, an insurance safeguard can be applied (910) that alters insurance enabled hybrid game gameplay. If a negative outcome is not detected, the process ends.

Figure 10:
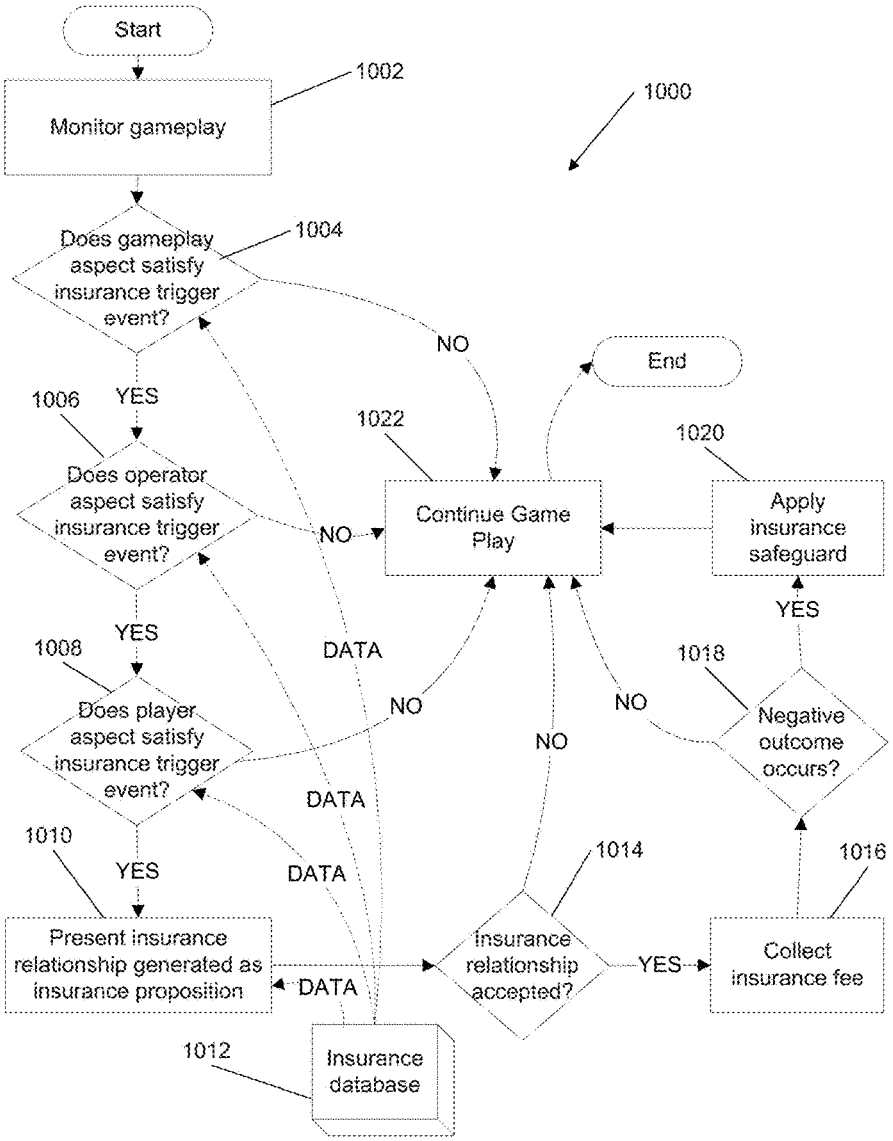
FIG. 10 illustrates a flow chart of a process for executing an insurance enabled hybrid game gameplay session using an insurance database in accordance with an embodiment of the invention.

A flow chart of a process for executing an insurance enabled hybrid game gameplay session using an insurance database in accordance with an embodiment of the invention is illustrated in FIG. 10. The process 1000 includes monitoring (1002) information received by an insurance module concerning insurance enabled hybrid game gameplay in accordance with an insurance activation rule. An insurance trigger event can include conditions concerning a variety of aspects of insurance enabled hybrid game gameplay, including a gameplay aspect, operator aspect and player aspect. A decision (1004) can be made as to whether the gameplay environment aspect is indicative of an insurance trigger event as determined from information retrieved from an insurance database 1012, such as but not limited to the presence of a challenge. If the gameplay environment aspect is not indicative of an insurance trigger event, then gameplay continues (1022). If the gameplay environment aspect is indicative of an insurance trigger event, then a decision (1006) can be made as to whether the operator aspect is indicative of an insurance trigger event as determined from information retrieved from an insurance database 1012, such as but not limited to whether an operator allows for the activation of insurance propositions. If the operator aspect is not indicative of an insurance trigger event, then gameplay continues (1022). If the operator aspect is indicative of an insurance trigger event, then a decision (1008) can be made as to whether the player aspect is indicative of an insurance trigger event as determined from information retrieved from an insurance database 1012, such as but not limited to whether a player is still participating in an entertainment game gameplay session. If the player aspect is not indicative of an insurance trigger event, then gameplay continues (1022). If the player aspect is indicative of an insurance trigger event, then an insurance activation rule determines that an insurance trigger event has occurred and activates an insurance proposition that generates (1010) at least one insurance relationship for presentation as determined from information retrieved from an insurance database 1012. A decision (1014) can also be made as to whether an insurance relationship is accepted by a player. If an insurance relationship is not accepted by a player, then gameplay continues (1022). If an insurance relationship is accepted by a player, then an insurance fee is collected (1016) from the player account of the player that accepts the insurance relationship. A decision (1018) can be made as to whether a negative outcome from a challenge in an accepted insurance relationship occurs. If the negative outcome does not occur, then gameplay continues (1022). If the negative outcome occurs, then the insurance safeguard is applied (1020) that alters insurance enabled hybrid game gameplay in accordance with the accepted insurance relationship and gameplay continues (1022).

Figure 11:
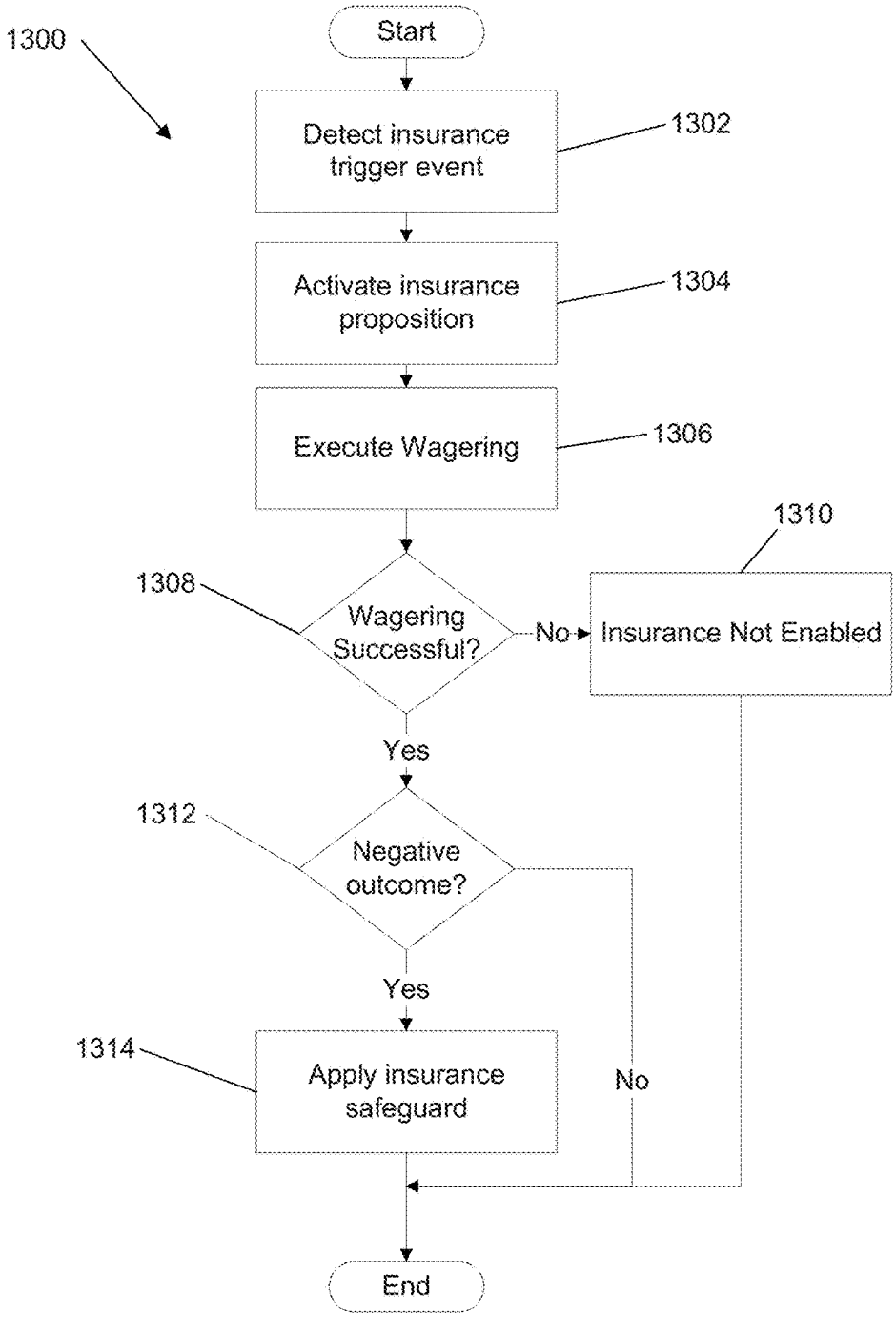
FIG. 11 illustrates a flow chart of a process for executing an insurance enabled hybrid game gameplay session using a wagering event in accordance with an embodiment of the invention.

A flow chart of a process for executing an insurance enabled hybrid game gameplay session using a wagering event in accordance with an embodiment of the invention is illustrated in FIG. 11. The process 1300 includes detecting (1302) an insurance trigger event. An insurance proposition can be activated (1304) that generates at least one insurance relationship between a wagering in a gambling game portion of an insurance enabled hybrid game and an insurance safeguard whose application mitigates the effect of a negative outcome from a challenge during gameplay of an entertainment game portion of an insurance enabled hybrid game. If the insurance proposition is activated, one or more wagers are executed (1306) in the gambling game portion of the insurance enabled hybrid game. If the one or more wagers are successful, that is, the one or more wagers return a favorable outcome for the player, the insurance safeguard is enabled and a decision can be made (1312) as to whether a negative outcome from a challenge is detected. If a negative outcome is detected, the enabled insurance safeguard can be applied (1314) that alters insurance enabled hybrid game gameplay. If a negative outcome is not detected, the process ends. If the one or more wagers are not successful, that is, the wagers return an unfavorable outcome for the player, the insurance safeguard is not enabled and the process ends.

Although various constructions of insurance modules are discussed above, insurance modules can be constructed to facilitate insurance enabled entertainment game gameplay as appropriate to the requirements of a specific application in accordance with embodiments of the invention. In certain embodiments, insurance modules can utilize various types of information in applying an insurance safeguard in response to a negative outcome from a challenge in insurance enabled entertainment game gameplay. A discussion of a processing apparatus that can be implemented in an insurance enabled hybrid game is presented below.

Processing Apparatus

Figure 12:
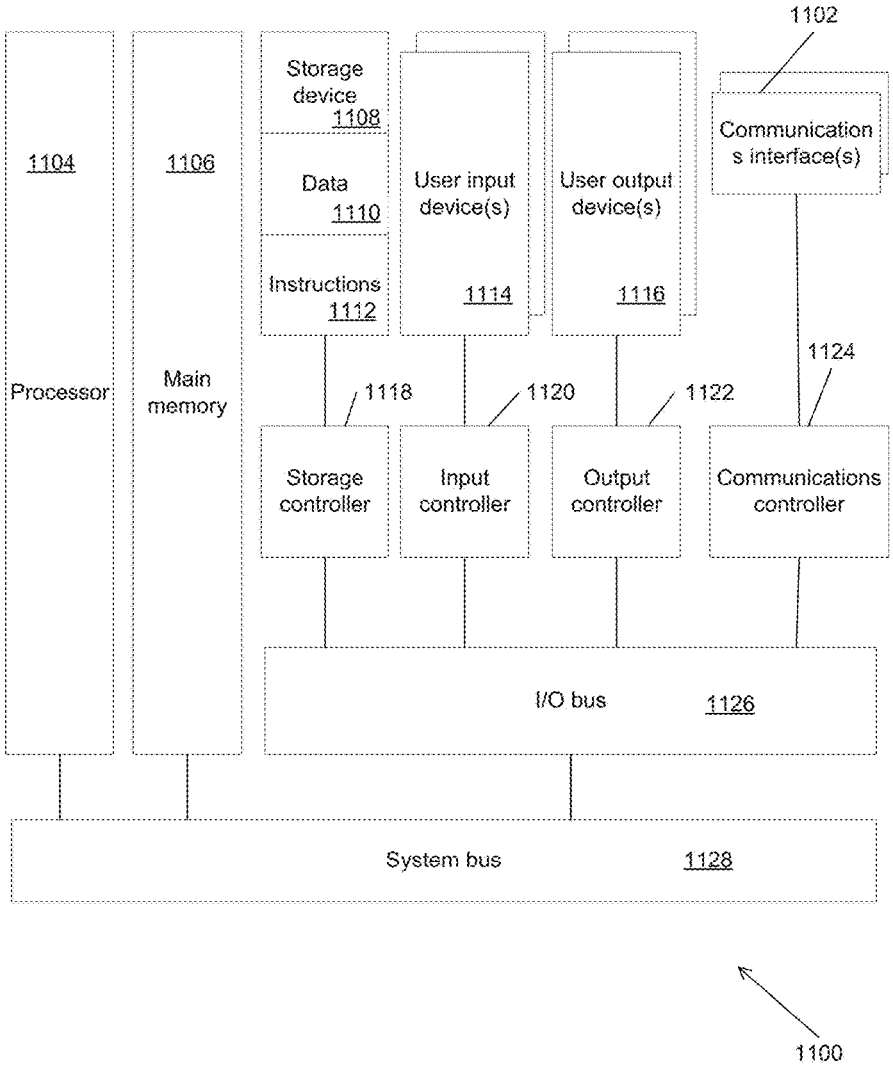
FIG. 12 illustrates a hardware architecture diagram of a processing apparatus utilized in the implementation of an insurance enabled hybrid game in accordance with an embodiment of the invention.

Any of a variety of processing apparatuses can host various components of an insurance enabled hybrid game in accordance with embodiments of the invention. In several embodiments, these processing apparatuses can include, but are not limited to, a gaming machine, a general purpose computer, a computing device and/or a controller. A processing apparatus that is constructed to implement an insurance enabled hybrid game in accordance with an embodiment of the invention is illustrated in FIG. 12. In the processing apparatus 1100, a processor 1104 is coupled to a memory 1106 by a bus 1128. The processor 1104 is also coupled to non-transitory processor-readable storage media, such as a storage device 1108 that stores processor-executable instructions 1112 and data 1110 through the system bus 1128 to an I/O bus 1126 through a storage controller 1118. The processor 1104 is also coupled to one or more interfaces that may be used to connect the processor to other processing apparatuses as well as networks as described herein. The processor 1104 is also coupled via the bus to user input devices 1114, such as tactile devices including but not limited to keyboards, keypads, foot pads, touch screens, and/or trackballs, as well as non-contact devices such as audio input devices, motion sensors and motion capture devices that the processing apparatus may use to receive inputs from a user when the user interacts with the processing apparatus. The processor 1104 is connected to these user input devices 1114 through the system bus 1128, to the I/O bus 1126 and through the input controller 1120. The processor 1104 is also coupled via the bus to user output devices 1116 such as (but not limited to) visual output devices, audio output devices, and/or tactile output devices that the processing apparatus uses to generate outputs perceivable by the user when the user interacts with the processing apparatus. In several embodiments, the processor is coupled to visual output devices such as (but not limited to) display screens, light panels, and/or lighted displays. In a number of embodiments, the processor is coupled to audio output devices such as (but not limited to) speakers, and/or sound amplifiers. In many embodiments, the processor is coupled to tactile output devices like vibrators, and/or manipulators. The processor is connected to output devices from the system bus 1128 to the I/O bus 1126 and through the output controller 1122. The processor 1104 can also be connected to a communications interface 1102 from the system bus 1128 to the I/O bus 1126 through a communications controller 1124.

In various embodiments, a processor loads the instructions and the data from the storage device into the memory and executes the instructions and operates on the data to implement the various aspects and features of the components of a gaming system as described herein. The processor uses the user input devices and the user output devices in accordance with the instructions and the data in order to create and operate user interfaces for players, casino operators, and/or owners as described herein.

Although the processing apparatus is described herein as being constructed from a processor and instructions stored and executed by hardware components, the processing apparatus can be composed of only hardware components in accordance with many embodiments. In addition, although the storage device is described as being coupled to the processor through a bus, those skilled in the art of processing apparatuses will understand that the storage device can include removable media such as but not limited to a USB memory device, an optical CD ROM, magnetic media such as tape and disks. Also, the storage device can be accessed through one of the interfaces or over a network. Furthermore, any of the user input devices or user output devices can be coupled to the processor via one of the interfaces or over a network. In addition, although a single processor is described, those skilled in the art will understand that the processor can be a controller or other computing device or a separate computer as well as be composed of multiple processors or computing devices.

In numerous embodiments, any component of an insurance enabled hybrid game, including an RWE, GWE or ESE, as described herein can be implemented on multiple processing apparatuses, whether dedicated, shared or distributed in any combination thereof, or may be implemented on a single processing apparatus. In addition, while certain aspects and features of insurance enabled hybrid game processes described herein have been attributed to an RWE, GWE, or ESE, these aspects and features may be implemented in a hybrid form where any of the features or aspects may be performed by any of a RWE, GWE, ESE within an insurance enabled hybrid game without deviating from the spirit of the invention.

While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. An insurance enabled hybrid gaming system, comprising:

a terminal including an entertainment software engine constructed to:

receive from a player a contribution of a credit; and provide an entertainment game;

a real world engine constructed to provide a gambling game in which the credit is wagered;

a game world engine connecting the entertainment software engine and the real world engine using a network, the game world engine configured to:

receive, from the entertainment software engine, a gameplay gambling event occurrence based upon a player's skillful execution of the entertainment game that triggers a wager in a gambling game;

communicate, to the real world engine, the gameplay gambling event occurrence;

detect an insurance trigger event;

activate an insurance proposition associated with the insurance trigger event to generate at least one insurance relationship between the wager in the gambling game and an insurance safeguard that mitigates the effect of a negative outcome during gameplay of the entertainment game;

communicate, to the real world engine, an indication to collect an insurance fee from a player profile in accordance with the activated insurance proposition; and communicate, to the entertainment software engine, the insurance proposition.

2. The insurance enabled hybrid gaming system of claim 1, wherein an insurance database is used to store information accessible to the game world engine selected from the group consisting of: insurance trigger events, insurance relationships and insurance proposition rules.

3. The insurance enabled hybrid gaming system of claim 1, wherein the insurance proposition further includes an acceptance of an insurance relationship from a user interface associated with the player in order to collect the insurance fee from the player profile.

4. The insurance enabled hybrid gaming system of claim 1, wherein the insurance proposition includes collection of the insurance fee from the player profile in order to apply the insurance safeguard.

5. The insurance enabled hybrid gaming system of claim 1, wherein the insurance trigger event is a configuration of gameplay resources present in an insurance enabled hybrid gaming system gameplay session associated with a player selected from the group consisting of: real world credits, game world credits and elements, where elements are a limited resource consumed within the entertainment game to advance entertainment game gameplay.

6. The insurance enabled hybrid gaming system of claim 1, wherein the insurance fee includes an amount of gameplay resources selected from the group consisting of: real world credits, game world credits and elements, where elements are a limited resource consumed within the entertainment game to advance entertainment game gameplay.

7. The insurance enabled hybrid gaming system of claim 1, wherein the insurance safeguard is a payout of gameplay resources to a player, where the gameplay resources are selected from the group consisting of: real world credits, game world credits and elements, where elements are a limited resource consumed within the entertainment game to advance entertainment game gameplay.

8. The insurance enabled hybrid gaming system of claim 1, wherein the insurance safeguard rolls back entertainment game gameplay progression to a point prior to the outcome of the challenge.

9. The insurance enabled hybrid gaming system of claim 1, wherein the insurance safeguard rolls back entertainment game gameplay progression by recording game state data that can be utilized to recreate the entertainment game at a point prior to the outcome of the challenge and restarting the entertainment game configured with the game state data to recreate entertainment game gameplay at the point prior to the outcome of the challenge.

10. The insurance enabled hybrid gaming system of claim 1, wherein the insurance safeguard advances a player in the entertainment game to a point beyond the challenge.

11. The insurance enabled hybrid gaming system of claim 10, wherein the insurance safeguard advances a player to a point beyond the challenge by storing game state data that can be utilized to execute the entertainment game at a point past the outcome of the challenge and restarting the entertainment game configured with the game state data to recreate entertainment game gameplay at the point past the challenge.

12. The insurance enabled hybrid gaming system of claim 1, wherein a player of an insurance enabled hybrid gaming system is an electronic representation of interactions associated with a player profile of the insurance enabled hybrid gaming system.

13. The insurance enabled hybrid gaming system of claim 1, wherein the credit is a currency fungible instrument.

14. The insurance enabled hybrid gaming system of claim 1, wherein the credit is a game world credit.

15. The insurance enabled hybrid gaming system of claim 1, wherein the credit is an enabling element of an entertainment game running on the entertainment software engine.

16. The insurance enabled hybrid gaming system of claim 1, wherein the game world engine and the real world engine are constructed from the same device.

17. The insurance enabled hybrid gaming system of claim 1, wherein the insurance proposition requires a successful wager for activation.

* * * * *